US010150637B2

(12) United States Patent
Wakayama et al.

(10) Patent No.: US 10,150,637 B2
(45) Date of Patent: Dec. 11, 2018

(54) STACKING APPARATUS

(71) Applicant: CANON KABUSHIKI KAISHA, Tokyo (JP)

(72) Inventors: Naoki Wakayama, Kawasaki (JP); Shuichi Masuda, Yokohama (JP); Takakazu Ohashi, Kawasaki (JP); Ryohei Maruyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 15/621,181

(22) Filed: Jun. 13, 2017

(65) Prior Publication Data

US 2017/0275124 A1 Sep. 28, 2017

Related U.S. Application Data

(62) Division of application No. 14/859,557, filed on Sep. 21, 2015.

(30) Foreign Application Priority Data

Sep. 30, 2014 (JP) ..... 2014-199753

(51) Int. Cl.
*B65H 31/26* (2006.01)
*B65H 31/30* (2006.01)
(Continued)

(52) U.S. Cl.
CPC ..... *B65H 31/26* (2013.01); *B65H 29/34* (2013.01); *B65H 31/02* (2013.01); *B65H 31/22* (2013.01); *B65H 31/3009* (2013.01); *B65H 37/04* (2013.01); *B65H 2220/09* (2013.01); *B65H 2301/4212* (2013.01); *B65H 2301/5151* (2013.01); *B65H 2402/42* (2013.01); *B65H 2403/41* (2013.01); *B65H 2403/732* (2013.01);
(Continued)

(58) Field of Classification Search
CPC ..... B65H 31/26; B65H 29/34; B65H 31/3009
See application file for complete search history.

(56) References Cited

U.S. PATENT DOCUMENTS 4,515,458 A 5/1985 Masuda et al.
4,530,593 A 7/1985 Kasuya et al.
(Continued)

FOREIGN PATENT DOCUMENTS

JP 2003-182915 A 7/2003
JP 2003-261255 A 9/2003
(Continued)

*Primary Examiner* — Luis A Gonzalez
(74) *Attorney, Agent, or Firm* — Fitzpatrick, Cella, Harper & Scinto

(57) ABSTRACT

There is provided a stacking apparatus capable of stably conveying and stacking sheets without occurrence of damage or buckling of the sheets in the structure of discharging the curled sheets one by one. In regard to each of a plurality of clamp guides which project toward stacking trays from a conveyor to guide sheets S, the projecting position varies in accordance with a size and an amount of stacked sheets on the stack trays. The stacking tray comprises an inclined surface and a curved surface. An upper guide is located to face the inclined surface by a predetermined interval, and the upper guide is located not to face the curved surface or is located to face it by an interval larger than a predetermined interval.

8 Claims, 24 Drawing Sheets

(51) Int. Cl.

| | |
|---|---|
| ***B65H 31/22*** | (2006.01) |
| ***B65H 29/34*** | (2006.01) |
| ***B65H 31/02*** | (2006.01) |
| ***B65H 37/04*** | (2006.01) |

(52) U.S. Cl.

CPC ..... *B65H 2404/1521* (2013.01); *B65H 2404/1522* (2013.01); *B65H 2405/115* (2013.01); *B65H 2405/1114* (2013.01); *B65H 2405/1118* (2013.01); *B65H 2405/11151* (2013.01); *B65H 2511/20* (2013.01); *B65H 2511/51* (2013.01); *B65H 2513/10* (2013.01); *B65H 2513/53* (2013.01); *B65H 2515/40* (2013.01); *B65H 2515/805* (2013.01); *B65H 2701/11312* (2013.01); *B65H 2801/12* (2013.01); *B65H 2801/31* (2013.01); *B65H 2801/36* (2013.01)

(56) References Cited

U.S. PATENT DOCUMENTS

| | | | | |
|---|---|---|---|---|
| 4,540,170 | A | 9/1985 | Masuda et al. | |
| 5,157,450 | A | 10/1992 | Kim | |
| 5,260,759 | A | 11/1993 | Kobayashi | |
| 6,244,583 | B1 | 6/2001 | Ohmichi et al. | |
| 6,793,425 | B2 | 9/2004 | Yoshikawa et al. | |
| 7,033,014 | B2 | 4/2006 | Ohashi et al. | |
| 7,055,949 | B2 | 6/2006 | Ohashi | |
| 7,063,417 | B2 | 6/2006 | Iwakura et al. | |
| 7,063,473 | B2 | 6/2006 | Ohashi et al. | |
| 8,910,934 | B2 * | 12/2014 | Yamazaki | B65H 29/00 271/176 |
| 2012/0263514 | A1 | 10/2012 | Tanami et al. | |
| 2014/0225967 | A1 | 8/2014 | Orue et al. | |
| 2014/0239113 | A1 | 8/2014 | Igarashi et al. | |

FOREIGN PATENT DOCUMENTS

| | | | |
|---|---|---|---|
| JP | 2007-223702 | A | 9/2007 |
| JP | 2008-156012 | A | 7/2008 |
| JP | 2009-173401 | A | 8/2009 |
| JP | 2013-151345 | A | 8/2013 |
| WO | 2015/185119 | A1 | 12/2015 |

* cited by examiner

| | | USE ENVIRONMENT | | |
|---|---|---|---|---|
| | | LOW-TEMPERATURE AND LOW-HUMIDITY | ROOM TEMPERATURE | HIGH-TEMPERATURE AND HIGH-HUMIDITY |
| SHEET TYPE | ORDINARY PAPER | X | W | W |
| | COATED PAPER | X | W | W |
| | CALENDERED PAPER | Z | Y | Y |

SETTING TIME (RETRACTING START TIME) : W<X、Y<Z

FIG.10

| ENVIRONMENT : 25°C | MINIMUM CURL DIAMETER |
|---|---|
| ORDINARY PAPER A | 71 |
| ORDINARY PAPER B | 69 |
| ORDINARY PAPER C | 70 |
| COATED PAPER A | 71 |

IN MILLIMETER

FIG.17

STACKING APPARATUS

BACKGROUND OF THE INVENTION

Field of the Invention

The present invention relates to a stacking apparatus for stacking discharged sheets.

Description of the Related Art

In an apparatus for discharging a large-sized sheet as an output, such as a large-sized inkjet printer, the outputs may be accommodated in a container such as a basket. However, continuously discharging a plurality of the sheets into such a basket may cause the outputs to collide with each other every time a new sheet is discharged, possibly resulting in occurrence of damage, buckling and/or the like. Further, in the structure of printing an image on a continuous sheet held in a roll form before cutting the continuous sheet in accordance with the image, the cut sheet remains curled, making it difficult to stack and keep hold of a large number of sheets in the basket. Then, in recent years, a stacking apparatus (stacker) is provided to orderly stack sheets discharged from an apparatus for handling large-sized sheets.

Most of stacking apparatuses are structured such that a stacking tray for holding the discharged sheets is placed in a position downward in the gravity direction from the discharge port of a discharging apparatus and the discharged sheets respectively drop in order due to each own weight of the sheets to be stacked thereon. However, in a case of conveying and stacking strongly curled sheets, the leading end of the sheet during the discharge possibly abuts at a large angle on a stacking surface of the stacking tray to cause a conveyance failure of the sheet.

For solving this problem, Japanese Patent Laid-Open No. 2003-182915 discloses a supplementary tray which can be taken in and out for guiding and supporting sheets from the discharge port to the stacking tray. According to Japanese Patent Laid-Open No. 2003-182915, at the time when the leading end of the sheet passes through, the supplementary tray projects to cover a level difference gap between the discharge port and the stacking surface, and guides the sheet from the discharge port to the stacking surface while supporting it. On the other hand, at the time when the rear end of the sheet passes through, the supplementary tray retracts to expose the level difference gap between the discharge port and the stacking tray and cause the sheet rear end to drop to a predetermined position of the stacking surface.

In a case where the sheet already stacked on the stacking tray remains curled in a convex shape due to the curl, when the leading end of the incoming sheet newly discharged comes in contact with the mid-slope of convex the curl and moves forward, the sheet already stacked on the stacking tray is possibly pushed out of the stacking tray. To address this, for example, Japanese Patent Laid-Open No. 2003-261255 discloses the structure in which a concave configuration is provided on the stacking tray in a position in which the rear end of the sheet should be aligned and the rear end of the sheet curled in the convex shape is caused to enter into the concave configuration. When the rear end of the sheet enters into the concave configuration, even if the mid-slope of the sheet is pushed in the conveyance direction by the incoming sheet newly discharged, the travel of the sheet can be restricted, resulting in the aligning stacking of the sheets.

However, according to the structure disclosed in Japanese Patent Laid-Open No. 2003-182915, the supplementary tray does not project enough to contact with the stacking tray or the already stacked top sheet. Therefore the level difference gap still exists to some extent between the supplementary tray and the stacking tray. Further, even if the posture of the supplementary tray is designed to be adjusted in accordance with the amount of the stacked sheets such that this level difference gap is made sufficiently small, when a sheet of a large width is discharged in a state where a sheet of a small width is stacked thereon, a large level difference gap exists in a region where the sheet of the small width is not stacked. As a result, when the largely curled sheet is conveyed, the leading end enters into the level difference gap, possibly making normal conveyance impossible.

As in the case of Japanese Patent Laid-Open No. 2003-261255, in the structure provided with the concave portion for restricting the rear ends of the already stacked sheets, when the sheet number of the stacked sheets becomes large (for example, 100 sheets or more), the rear end of the top sheet cannot be sufficiently subjected to the restriction by the concave portion. Therefore when the leading end of the incoming sheet newly discharged comes in contact with the mid-slope of the stacked curled sheet and moves forward, the stacked sheet is moved to destroy the stacking state.

SUMMARY OF THE INVENTION

The present invention has been made to address such problems. Therefore, it is an object of the present invention to provide a stacking apparatus capable of stably conveying and stacking sheets without occurrence of damage or buckling of the sheets in the structure of discharging the curled sheets one by one.

According to a first aspect of the present invention, there is provided a sheet stacking apparatus, comprising:

a tray on which a sheet is placed in an inclined condition; and a guide unit that guides a sheet conveyed on the tray and restrains an end of the sheet placed on the tray, wherein the guide unit comprises a plurality of movable guides which are divided in a width direction of the sheet and are movable in accordance with the sheet placed on the tray.

According to a second aspect of the present invention, there is provided a sheet stacking apparatus in which a sheet is supported in an inclined condition by a tray, and a part of the sheet is stacked in a hanging-downward condition from the tray, wherein the tray includes an inclined surface and a curved surface, wherein the sheet conveyed to the tray goes up in the upward direction against gravity along the inclined surface and hangs downward via the curved surface, an upper guide facing the inclined surface to have a predetermined interval therefrom is provided, wherein the upper guide is not faced the curved surface or faced a part of the curved surface in having an interval larger than the predetermined interval.

Further features of the present invention will become apparent from the following description of exemplary embodiments (with reference to the attached drawings).

BRIEF DESCRIPTION OF THE DRAWINGS

FIG. 8 is a flowchart describing processes to be executed by a controller with power turned on;

FIG. 10 is a table showing the relationship between a first predetermined time and a combination of use environment and sheet types;

FIG. 17 is a table showing a minimum curl diameter for each type of sheet;

DESCRIPTION OF THE EMBODIMENTS

Figure 1:
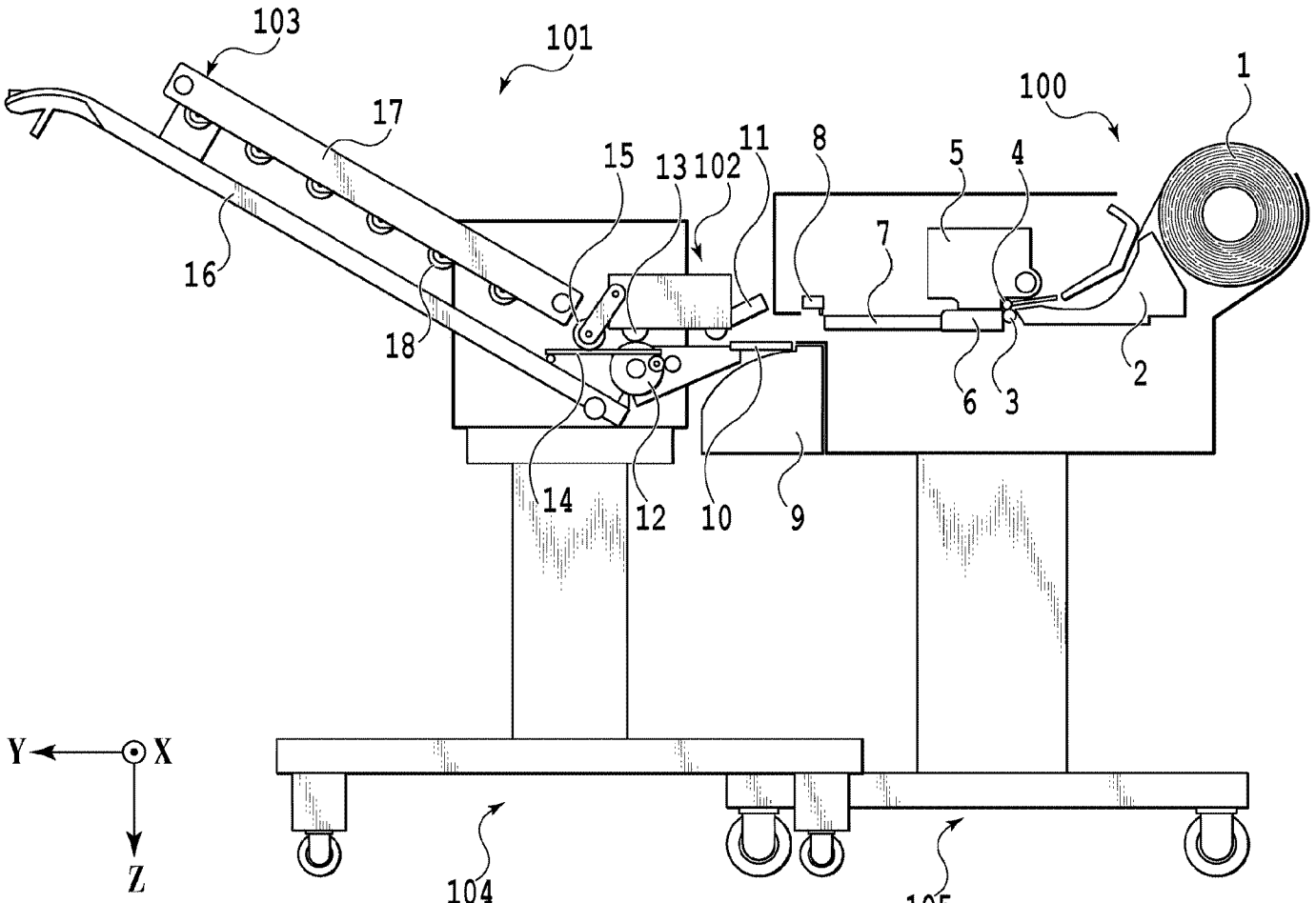
FIG. 1 is a sectional view illustrating a printer and a stacker connected to the printer.

FIG. 1 is a sectional view illustrating an inkjet printer (hereinafter called "printer") 100 and a stacker 101 (sheet stacking apparatus) connected to the printer 100. In the printer 100, a continuous sheet S is pulled from a roll sheet 1 held in a roll form to be conveyed toward the Y direction. Then, a predetermined image is printed thereon by a print head 5, and then the sheet S is cut in a position in accordance with a size of the image by a cutter 8, which is then discharged from a discharge guide 9. The cut sheet S discharged from the printer 100 is delivered into the stacker 101 and then placed on a tilted tray unit 103. The cut sheet delivered onto the tray unit 103 is held in a downward-hanging manner after moving along the inclined surface in the upward direction against gravity to a point beyond the crest. In this state, ink drying is done. A plurality of cut sheets S are sequentially delivered into the stacker because of the continuous printing, one being stacked on top of the earlier discharged sheet.

The stacker (stacking apparatus) according to the present invention is not limited to being used in a combination with the inkjet printer, may be used in a combination with another printing-type printer. Further, the stacker can be used for stacking sheets discharged from an image reader and other sheet processing devices as well as the printers.

The structure of the conveyance path will be now described in detail. The sheet S supplied from the roll sheet 1 is conveyed onto a platen 6 while being held between a printer conveyance roller 3 and a printer pinch roller 4. The platen 6 is located opposite to a print head 5 that ejects ink in response to image data, to support the sheet S from below during a printing operation. The platen 6 has a suction port formed to communicate with a duct and/or a suction fan (which are not illustrated) for suction from behind the sheet S during conveyance, maintaining flatness of the sheet S. After an image corresponding to one page has been printed with the progress of the printing operation of the inkjet-type print head 5, a cutter 8 cuts the sheet S in line with the rear end of the image.

After discharge of the leading end of the cut sheet S from the discharge guide 9 of the printer 100, the cut sheet S is delivered into the stacker 101 through a conveyance unit 102. A conveyance roller 12 placed in the conveyance unit 102 is driven at the time when a sheet detection sensor 22 installed in the stacker 101 detects the leading end of the cut sheet S discharged from the discharge guide 9, so that the cut sheet S is held between the conveyance roller 12 and a pinch roller 13 to be conveyed to the tray unit 103. When the cut sheet S is of a sufficient size, the sheet S is held in such a manner that the leading end hangs and extends downward beyond the end of a stacking tray 16.

The printer 100 is equipped with an operating part for a user to input a width size of the roll sheet 1 loaded, select between online and offline, input commands, and the like.

Figure 2:
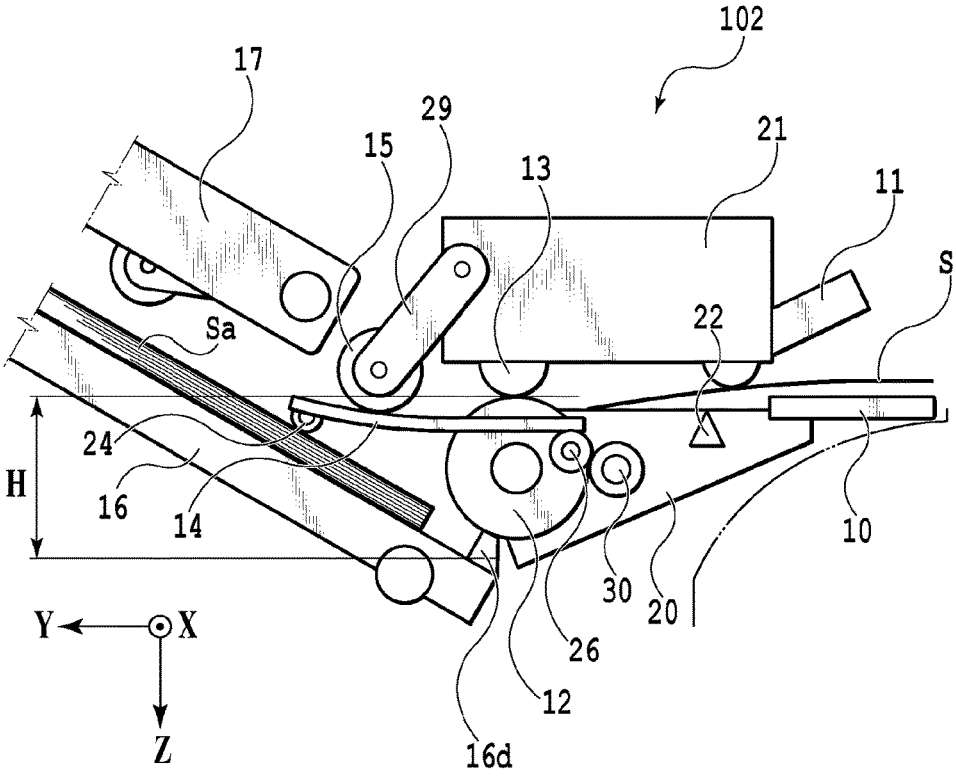
FIG. 2 is sectional view illustrating the structure of a conveying unit.

FIG. 2 is a sectional view illustrating the structure of the conveyance unit 102 that is a conveyance mechanism located on the most upstream side of the sheet conveyance course in the stacker 101. The sheet S, which has been discharged from the discharge guide 9 of the printer 100, is inserted into between a joint part 10 and an upper guide 11, and then is moved forward through between them while being supported by the joint part 10 and reduced in curl by the upper guide 11.

A lower conveyance guide 20 and an upper conveyance guide 21 are provided to guide the sheet S having reached between joint part 10 and the upper guide 11, further to a nipping portion between the conveyance roller 12 and the pinch roller 13. The pinch roller 13 is rotatably mounted in the upper conveyance guide 21 in such a manner as to be urged toward the conveyance roller 12 by unillustrated urging means. Further, a discharge roller holder 29 is rotatably attached to the upper conveyance guide 21 to support a discharge roller 15. On the other hand, in the middle of the lower conveyance guide 20, the sheet detection sensor 22 is provided for detection of the leading end and/or the rear end of the sheet S.

The sheet S, which has passed through the nipping portion between the conveyance roller 12 and the pinch roller 13, is moved forward through between an upper guide 17 and the stacking tray 16 of the tray unit 103, and finally held as stacked sheets Sa on the stacking tray 16. The upper guide 17 and the stacking tray 16 are inclined with respect to the horizontal direction (Y direction). The upstream end of the stacking tray 16 is located in a position lower by a distance H than the nipping portion between the conveyance roller 12 and the pinch roller 13 in the gravity direction (Z direction). An adjoining portion 16*d*, which is formed at the upstream end of the stacking tray 16, abuts on the conveyance roller 12 in a comb-teeth manner, thus preventing the stacked sheets Sa from slipping down from the stacking tray 16.

A clamp guide 14 (movable guide) is provided to enable connection and disconnection between the nipping portion and the stacking tray 16. The clamp guide 14 is formed of a flat plate somewhat warping in response to a pressure from outside, and is capable of being moved forward and backward in the Y direction in the figure by moving means which will be described later. The clamp guide 14 plays a role as a guide of smoothly guiding sheets carried into the stacking tray 16 and a role as a clamper of pressing the distal ends of the sheets placed on the stacking tray 16. In the present specification, the state where the clamp guide 14 has moved to the most rearward position is herein referred to as a retract state, and the state where the clamp guide 14 has moved forward in the Y direction is herein referred to as a projecting state. FIG. 2 illustrates the projecting state where the clamp guide 14 has moved forward in the Y direction.

A roller 24 that is a rolling element is attached to the leading end of the clamp guide 14. While maintaining contact with the stacking tray 16 or the stacked sheets Sa, the roller 24 is rotated to move forward in the Y direction. In the projecting state illustrated in FIG. 2, the roller 24 abuts on the top sheet Sa of the sheets stacked on the stacking tray 16. Placement of such a roller 24 makes it possible to prevent the stacked sheets Sa from being misaligned in the Y direction without damage to them.

In the projecting state, the discharge roller 15 is in contact with the upper surface of the clamp guide 14, so that the discharge roller 15, together with the discharge roller holder 29, is lifted by the reaction of the clamp guide 14. Upon discharge of a new sheet S in this state, the new sheet S is conveyed in the Y direction with the rotation of the discharge roller 15, while being guided by the clamp guide 14. Then, the new sheet S is stacked as a top sheet of the sheets stacked on the stacking tray 16. At this time, even if the newly discharged sheet S somewhat curls as shown in FIG. 2, the discharge roller 15 presses the sheet under its own weight, so that the sheet S during conveyance is able to maintain the sheet flatness. Because the level difference H is blocked by the clamp guide 14, there is no possibility that the leading end of the sheet S released from the discharge roller 15 goes into the gap of the level difference H to cause a sheet jam. Further, since the floating of the stacked sheets Sa placed on the stacking tray 16 is inhibited by the clamp guide 14, there is no possibility that the leading end of the newly discharged sheet S catches on the stacked sheets Sa or collides with a mid-slope of the stacked sheets Sa to push it out.

Figure 3:
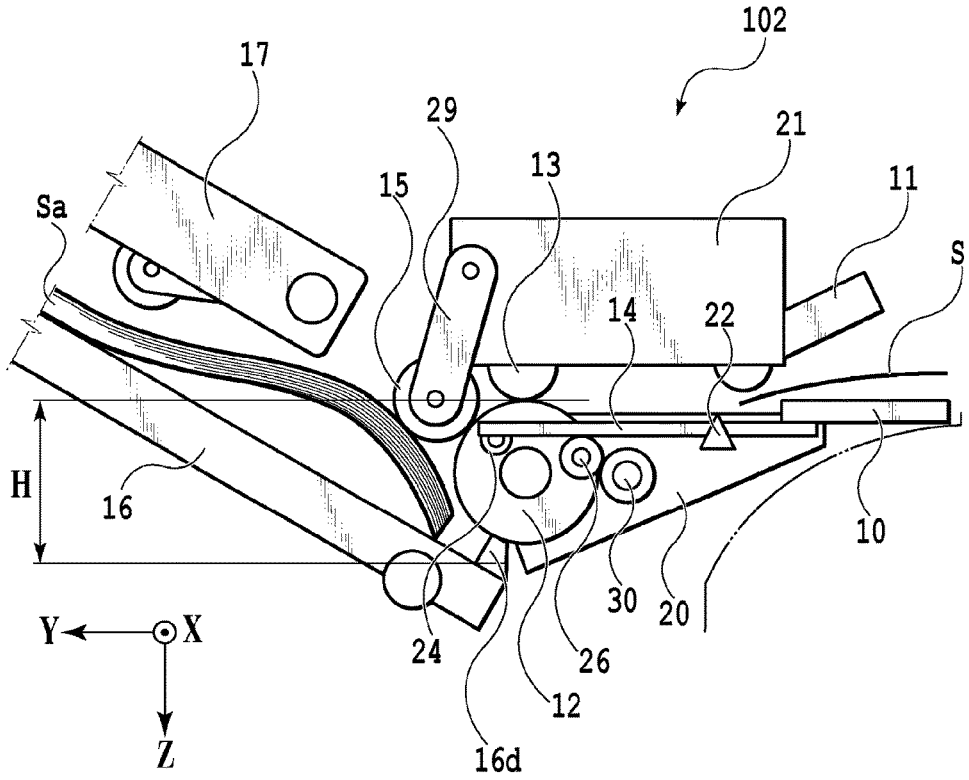
FIG. 3 is a diagram illustrating the retract state of a clamp guide.

FIG. 3 is a view illustrating the retract state of the clamp guide 14 after moving from the projecting state illustrated in FIG. 2 toward the negative Y direction. In the retract state, the clamp guide 14 is accommodated inside the lower conveyance guide 20, and the roller 24 is located within the outer diameter of the conveyance roller 12. Therefore, the discharge roller 15 is located in contact with the conveyance roller 12 because of its own weight. The level difference gap H between the nipping portion of the conveyance roller 12 and the stacking tray 16 is exposed. When a newly discharged sheet S has yet to reach the sheet detection sensor 22, such a retract state is maintained. Further, at the time when the rear end of the newly discharged sheet S leaves the nipping portion between the conveyance roller 12 and the pinch roller 13, the retract state is designed to be achieved. If the retract state is achieved at the time when the rear end of the sheet S leaves the nipping portion, the rear end of the sheet S can be dropped in the level difference gap to be aligned with the rear ends of the stacked sheets Sa having arrived earlier at the stacking tray 16.

Figure 4:
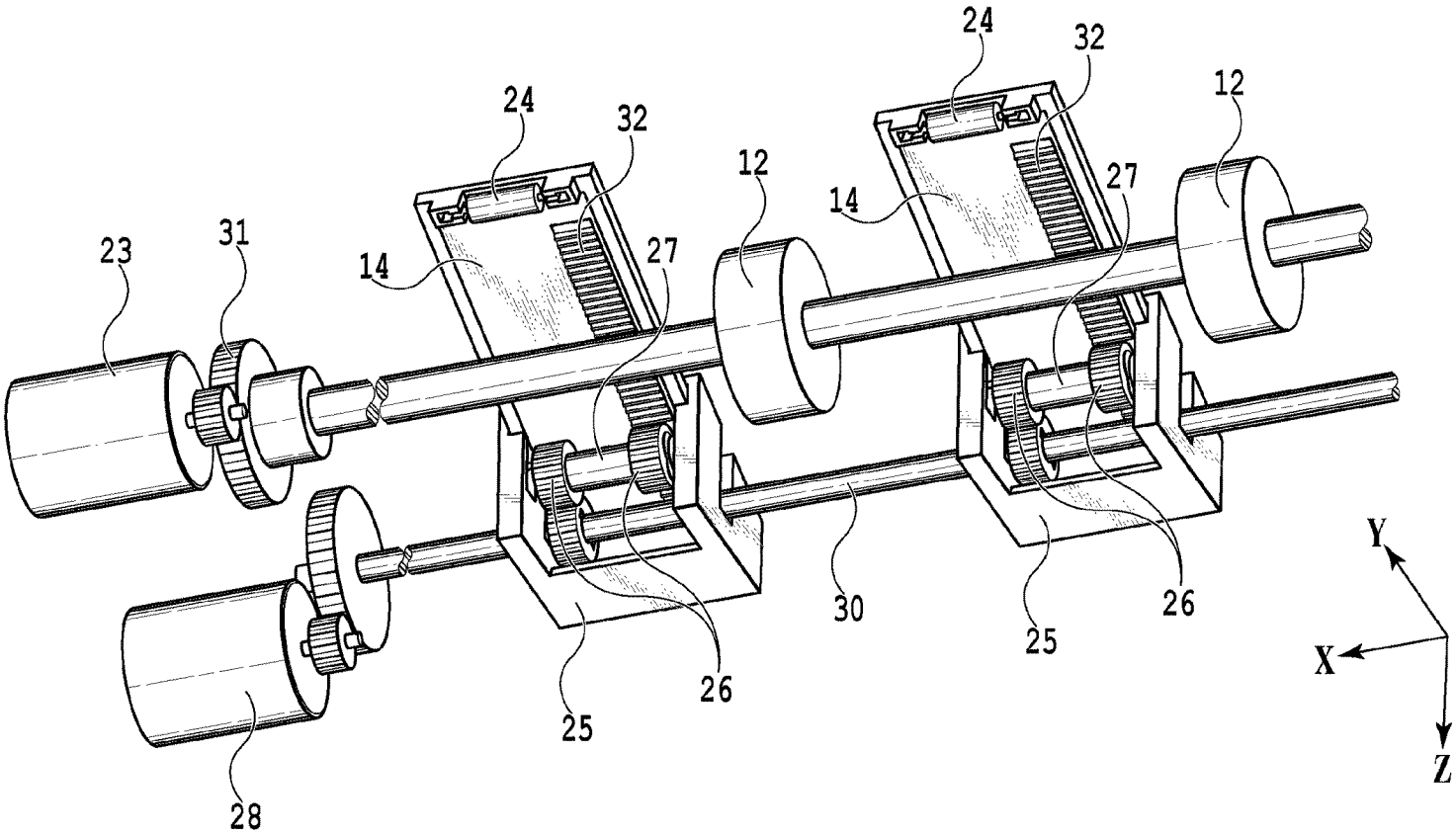
FIG. 4 is a perspective view illustrating the drive structure of conveying rollers and clamp guides.

FIG. 4 is a perspective view illustrating the driving structure of the conveyance roller 12 and the clamp guide 14. A plurality of the conveyance rollers 12 and a plurality of the clamp guides 14 are arranged alternately along the X direction intersecting with the conveyance direction (Y direction).

The conveyance rollers 12 are connected with each other to be rotatable by a conveyance-roller motor 23 through a common torque-limiter gear 31. The conveyance-roller motor 23 is driven at the time when the sheet detection sensor 22 detects the leading end of the sheet S to start rotating the conveyance rollers 12. When the sheet S is conveyed by both the printer conveyance roller 3 and the conveyance rollers 12 in the stacker 101, the conveyance rates of the conveyance rollers 3 and 12 are controlled to become equal. For example, when the conveyance operation of the printer conveyance roller 3 is stopped in the middle of the conveying process, the torque-limiter gear 31 with a limit value being reached starts sliding on the sheet S to stop the rotation of the conveyance rollers 12. On the other hand, when the sheet S is cut and the sheet S in the stacker 101-side is conveyed by the conveyance rollers 12 alone in the stacker 101, the conveyance rate of the conveyance rollers 12 is able to be independently controlled in the stacker 101-side.

The clamp guides 14 are held respectively in holders 25. A plurality of the holders 25 are connected to a clamp-guide motor 28 through a common clamp-guide shaft 30. By the drive force of the clamp-guide motor 28, gears 26 rotate in a forward or backward direction to move each clamp guide 14 forward or backward in the Y direction through guide rails 32 meshing with the gears 26. A torque limiter 27 is attached to the gears 26 of each holder 25. The extent of the forward movement or backward movement caused by the clamp-guide motor 28 is adjusted for each clamp guide 14 by the torque limiter 27.

Specifically, when the clamp-guide motor 28 rotates to move the clamp guides 14 forward, the rollers 24 of the respective clamp guides 14 come into contact with the stacking trays 16 or the stacked sheets Sa, and the torque limiters 27 are activated at the time of receiving reaction to some extent, the clamp guides 14 coming to a stop. That is, in a plurality of the clamp guides 14 arranged in the X direction, the extent of the forward movement is adjusted in accordance with the thickness of the stacked sheets in each position of the clamp guides 14.

Figure 5:
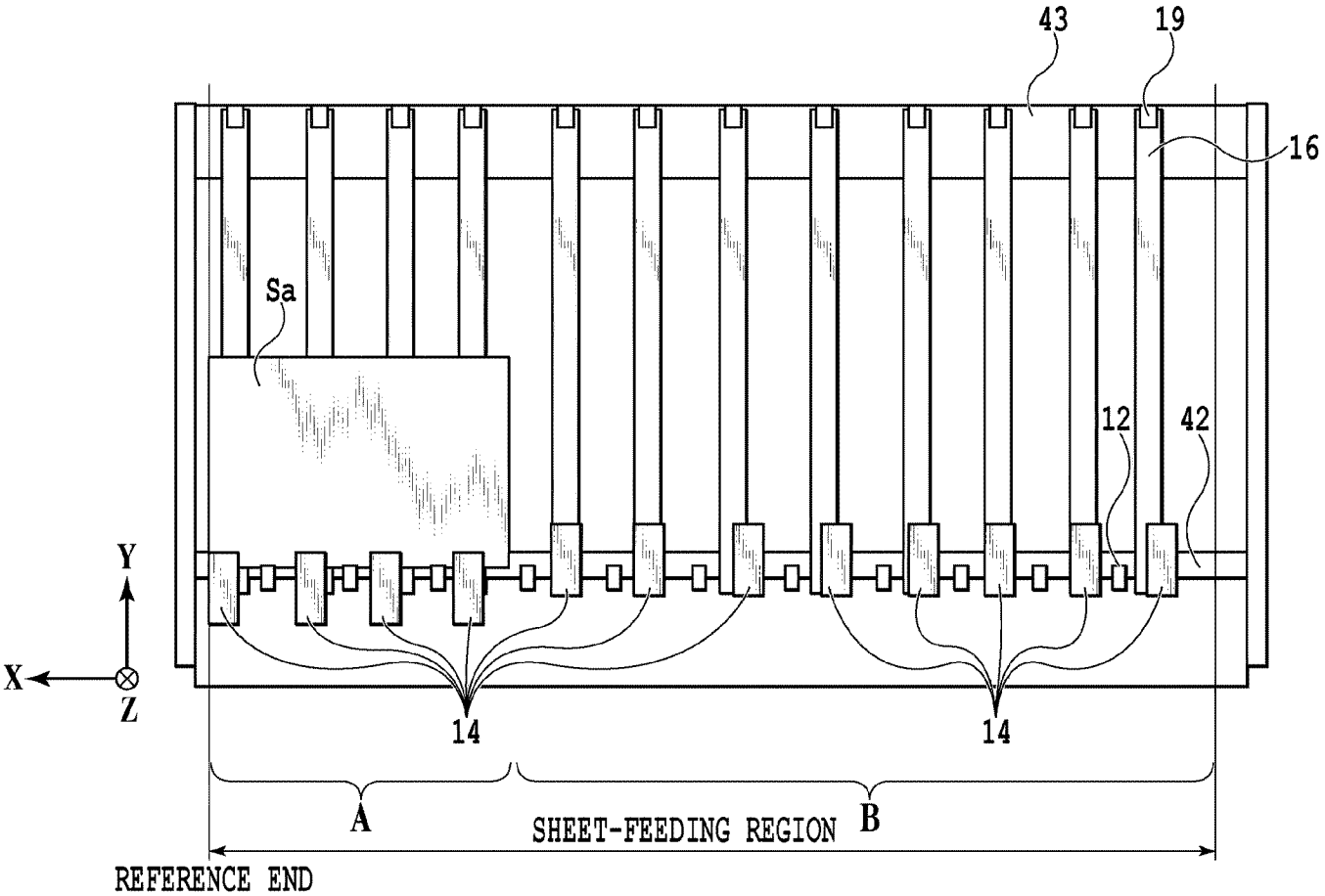
FIG. 5 is a top view illustrating the projecting state when sheets of a small size are stacked.

FIG. 5 is a top view illustrating a case where the clamp guides 14 transition from the retract state to the projecting state after the stacked sheets Sa of a comparatively small size have been stacked on the stacking trays 16. In FIG. 5, the upper guides 17 are removed. In the region A in which the stacked sheets Sa exist, as illustrated in FIG. 2, the rollers 24 rotate and move forward while being in contact with the surface of the stacked sheets Sa, and the clamp guides 14 themselves move forward in the Y direction while warping. The travel of the clamp guides 14 is stopped at a position when the torque limiters 27 surpasses a limit value. The torque limiters 27 are adjusted such that an excessive pressing force does not act on the stacked sheets Sa, thus preventing damage to the sheets.

Figure 6:
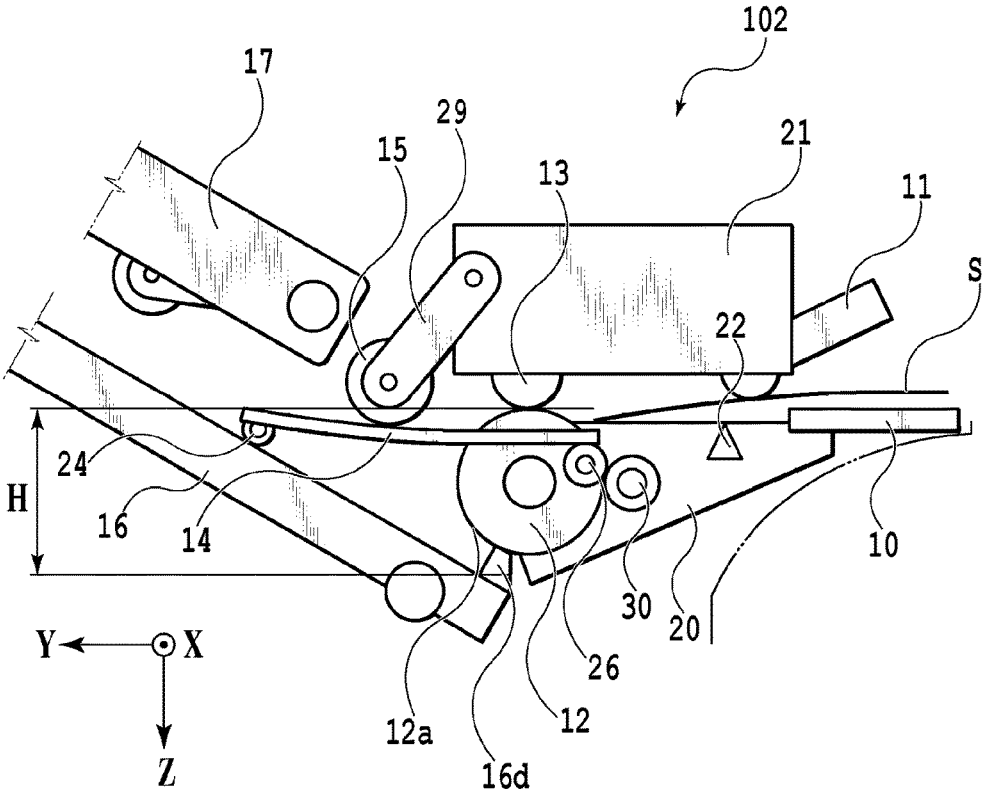
FIG. 6 is a sectional view illustrating the projecting state when no sheet is stacked.

On the other hand, for the clamp guides 14 located in the region B in which the stacked sheets Sa do not exist, the torque limiters 27 are activated to stop travel of the clamp guides 14 with the rollers 24 directly abutting on the stacking trays 16 as illustrated in FIG. 6. From a comparison between FIG. 2 and FIG. 6, it is seen that the amount of travel in the Y direction in FIG. 2 in which the rollers 24 abut at lesser depth (that is, at an earlier time) is smaller than that in FIG. 6 in which the rollers 24 abut at deeper depth (that is, at a later time). In other words, as shown in FIG. 5, the clamp guides 4 located in the region A have a smaller amount of travel in the Y direction than the clamp guides 14 located in the region B. In both the regions, the level difference gap H is fully blocked by the clamp guides 14, so that the leading end of the incoming sheet S newly conveyed does not enter into the level difference gap H.

Figure 7:
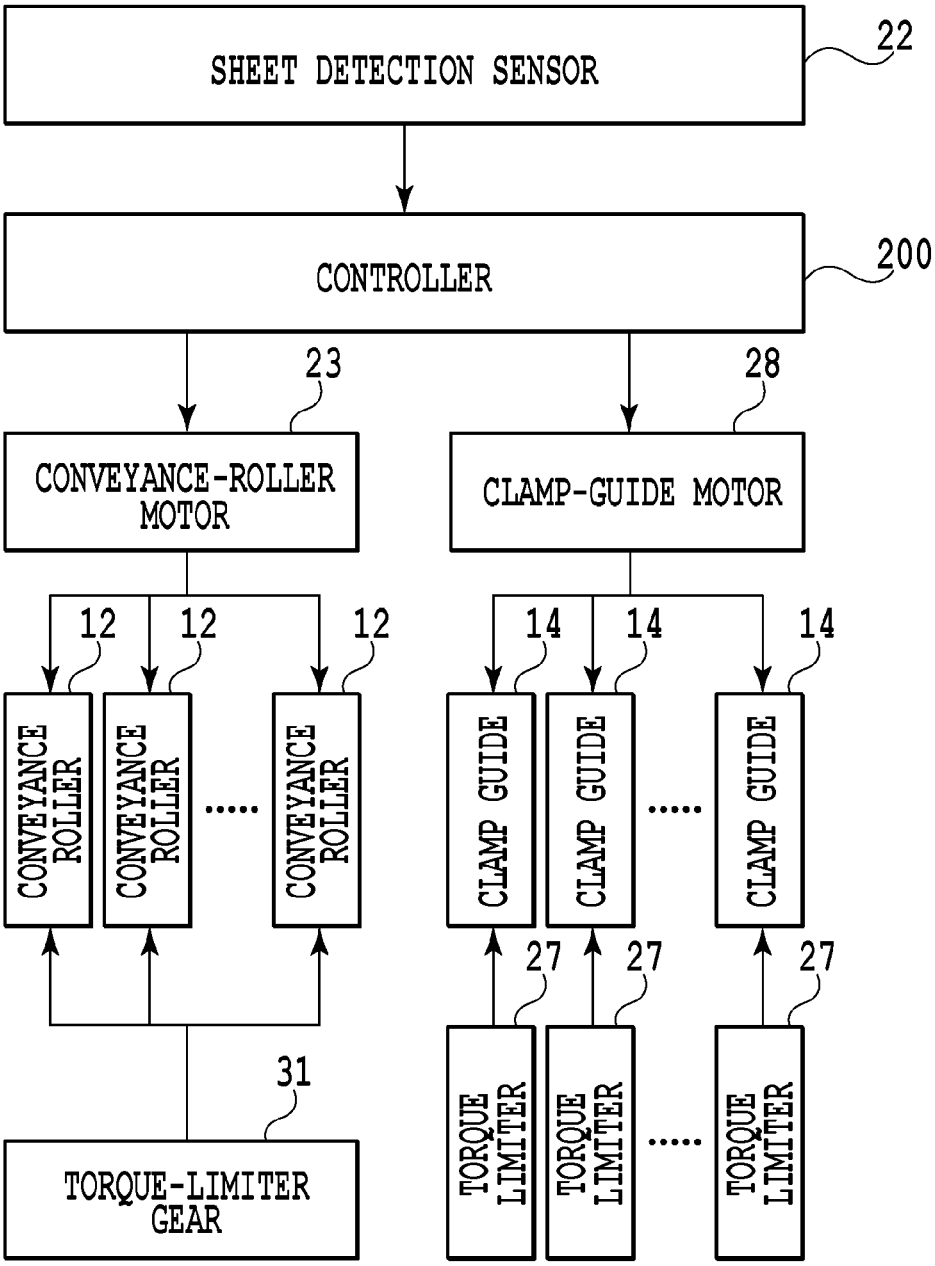
FIG. 7 is a control block diagram of the stacker.

FIG. 7 is a block diagram illustrating the control configuration in the stacker 101. A controller 200 drives the conveyance-roller motor 23 and the clamp-guide motor 28 in response to the detection result of the sheet detection sensor 22 and/or the like. As described earlier in FIG. 4, the conveyance-roller motor 23 rotates the plurality of conveyance rollers 12, and the rotation of the conveyance rollers 12 is uniformly limited by the common torque-limiter gear 31. On the other hand, the clamp-guide motor 28 controls the forward movement and the backward movement of the plurality of clamp guides 14, and the amount of travel of each of the clamp guides 14 is individually limited by the torque limiter 27 mounted in each of the clamp guides 14.

Figure 8:
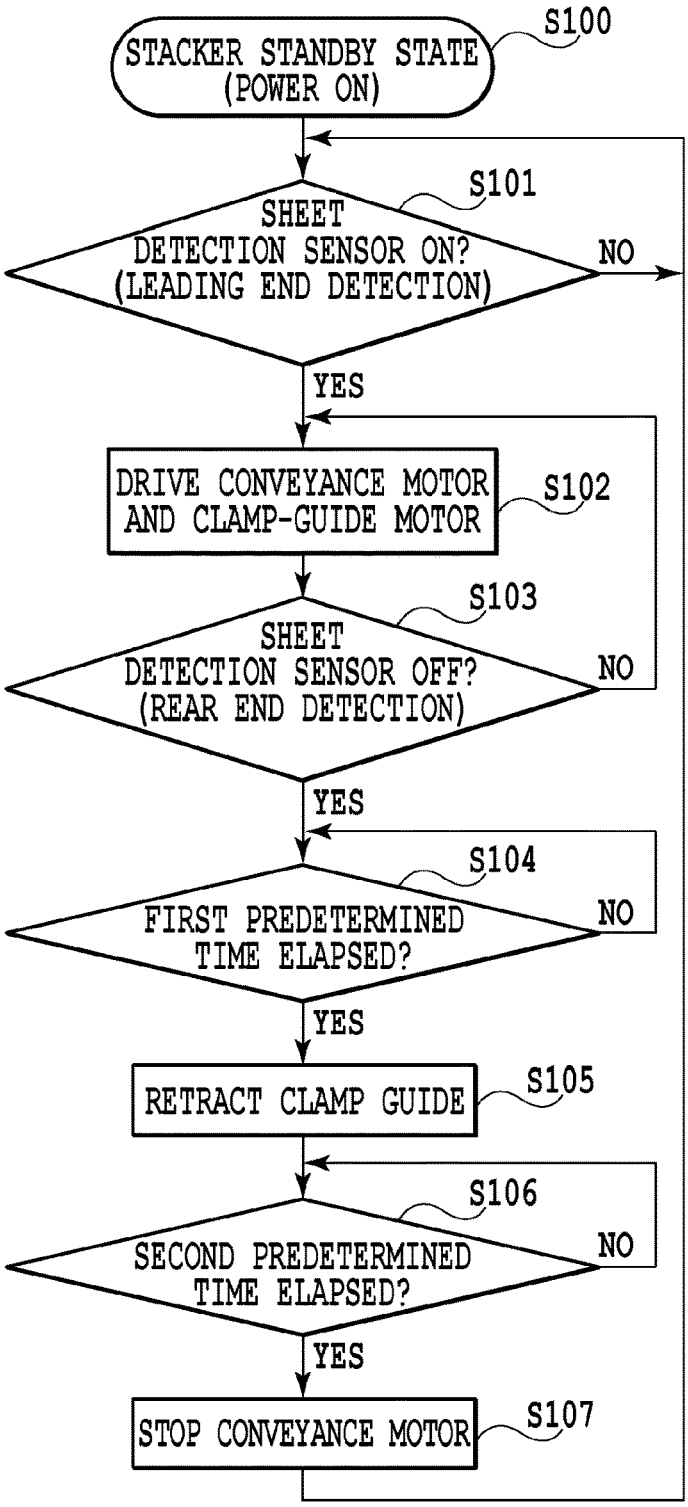

FIG. 8 is a flow chart illustrating processes executed by the controller 200 when the stacker is powered on. FIGS. 9A to 9F are diagrams illustrating conveying and stacking the sheets in each process.

Figure 9A:
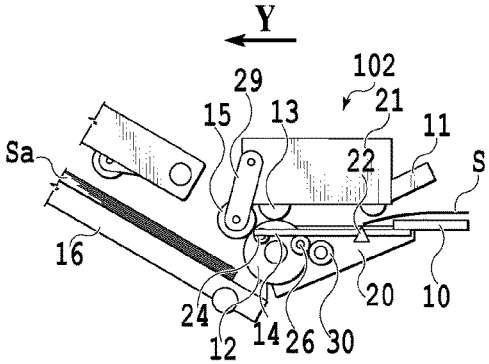
FIGS. 9A to 9F are diagrams illustrating the state of conveying and stacking sheets in the processes in FIG. 8.

After it is determined at step S100 that the power is turned on, the controller 200 goes to step S101, wherein it is determined whether or not the sheet detection sensor 22 detects the leading end of the sheet S. When the leading end of the sheet S is not detected, step S101 is periodically repeated until the leading end of the sheet S is detected. FIG. 9A illustrates the state at the time when the sheet detection sensor 22 detects the leading end of the sheet S. At this time, the clamp guides 14 are in the retract state, and the discharge rollers 15 are lowered by the own weight to make contact with the conveyance rollers 12.

Figure 9B:
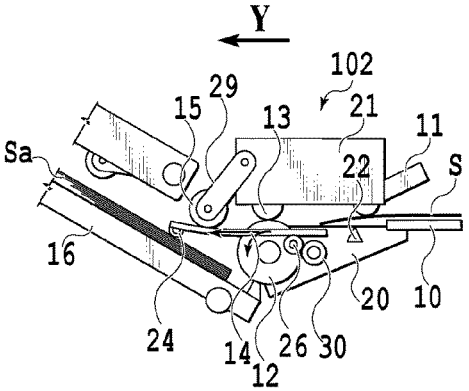

After the leading end of the sheet S is detected at step S101, the controller 200 goes to step S102, wherein the conveyance rollers 12 and the clamp guide motor 28 are driven. FIG. 9B illustrates the conveyance state of the sheet S during the motor operation. The conveyance rollers 12 rotate in the counterclockwise direction and the clamp guides 14 move forward in the Y direction to lift the discharge rollers 15, changing to the projecting state. The sheet S of which the leading end has been detected is then conveyed along the clamp guides 14 in the Y direction while being nipped between the conveyance rollers 12 and the pinch rollers 13.

Figure 9C:
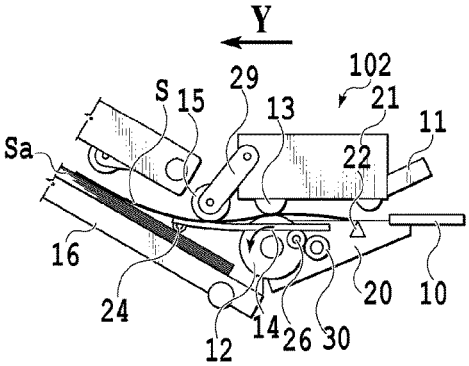

At step S103 the controller 200 determines whether or not the sheet detection sensor 22 detects the rear end of the sheet S. When the rear end of the sheet S is not detected, the controller 200 goes back to step S102, wherein the conveyance-roller motor 23 and the clamp-guide motor 28 continue to be driven. When the rear end of the sheet S is detected at step S103, the controller 200 goes to step S104. FIG. 9C shows the state at the time when the sheet detection sensor 22 detects the rear end of the sheet S.

Figure 9D:
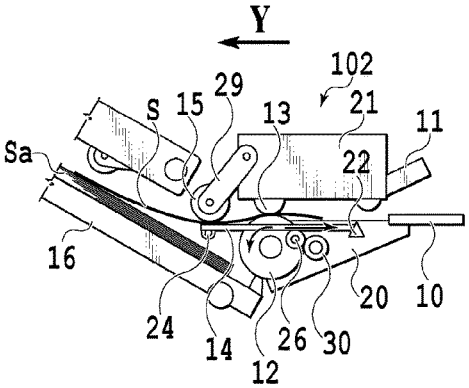
Figure 9E:
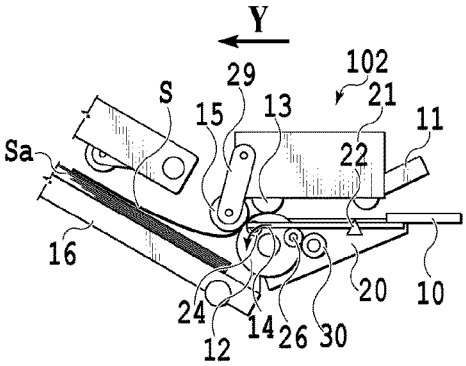

At step S104 the controller 200 determines whether or not a first predetermined time has elapsed from the time of detection of the rear end of the sheet S. When it is determined that the first predetermined time has not elapsed, the conveyance-roller motor 23 and the clamp-guide motor 28 continue to be driven. When it is determined at step S104 that the first predetermined time has elapsed, the controller 200 goes to step S105, wherein while maintaining the driving of the conveyance-roller motor 23, the clamp-guide motor 28 is rotated in the reverse direction to start retracting the clamp guides 14 in the negative Y direction. FIG. 9D shows the state where the clamp guides 14 are moving in the negative Y direction, and FIG. 9E shows the retract state in which the clamp guides 14 are completely retracted in the negative Y direction.

At the time when the rear end of the sheet S is discharged from the nipping portion between the conveyance rollers 12 and the pinch rollers 13, the clamp guides 14 have returned to the retract state completely. Hence, the discharge rollers 15 are in contact with the rotating conveyance rollers 12 to form a nipping portion, so that the rear end of the discharged sheet S is prevented from coming into contact with the retracting clamp guides 14 to be pulled back in the negative Y direction or from coming into contact with the conveyance rollers 12 to suffer occurrence of damage or buckling. Further, the level difference gap H between the stacking trays 16 and the nipping portion between the discharge rollers 15 and the conveyance rollers 12 is completely exposed, so that the rear end of the sheet S is dropped onto a prescribed position of the stacking trays 16. In this way, the first predetermined time is set such that the clamp guides 14 are placed in the projecting state as much as possible during the conveyance of the sheet S, but is returned completely to the retract state at the time when the rear end of the sheet S is discharged from the nipping area.

Figure 9F:
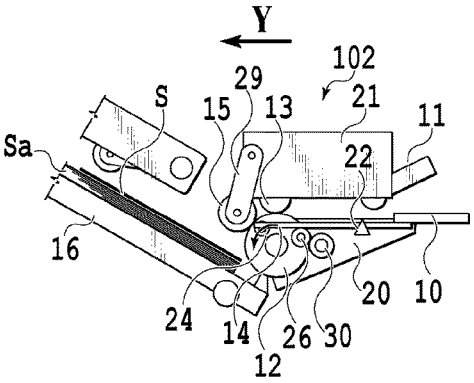

Then, at step S106, the controller 200 determines whether or not a second predetermined time has elapsed from the time of detection of the rear end of the sheet S, and continues to drive the conveyance motor 23 until it is determined that the second predetermined time has elapsed. In this connection, the second predetermined time is a value larger than the first predetermined time, and is a sufficient length of time for the rear end of the sheet S to be dropped onto the stacking trays 16 after having passed through the sheet detection sensor 22. FIG. 9F illustrates the state at the instant following the dropping of the rear end of the sheet onto the stacking trays 16. When it is determined at step S106 that the second predetermined time has elapsed, the controller 200 goes to step S107 to stop the driving of the conveyance motor 23. Then, the controller 200 goes back to step S101 again to wait for the passage of the leading end of the subsequent sheet.

Hereinafter, a method of setting the first predetermined time will be described. As described earlier, the first predetermined time is set for the time the clamp guides 14 start to move backward in order to return to the retract state at the time when the rear end of the sheet S is discharged from the nipping portion after the clamp guides 14 have been maintained in the projecting state as much as possible. The projecting state is maintained as much as possible during the conveyance of the sheet S in order to minimize the time and the distance during which the stacked sheets Sa are subjected to the friction of a newly discharged sheet S for the prevention of multi-feeding.

However, the possibility of occurrence of such multi-feeding varies depending on a use environment of the stacker 101 and/or a sheet type of the sheet S. Even if multi-feeding occurs somewhat, depending upon the use environment or the sheet type, the rear ends of the stacked sheets Sa may be aligned because of the inclination of the stacking tray 16 at the time when the sheet discharge is completed, so that the stacking performance may not be affected. That is, when multi-feeding easily occurs, the timing of starting the backward movement of the clamp guides 14 is recommended to be set as late as possible. On the other hand, when the multi-feeding is not much of a problem, the backward movement of the clam guides 14 is preferably started earlier with time to spare, with consideration given to a conveyance speed error and the like. Accordingly, in the present embodiment, the first predetermined time is changed depending on the use environment of the stacker and the type of sheet.

FIG. 10 is a table showing the relationship between a combination of use environment and sheet type and a first predetermined time in accordance with this. For example, in the use in a low-temperature and low-humidity environment, the stiffness and the friction of a sheet increase as compared with in other environments, causing multi-feeding to occur easily. Therefore, in the low-temperature and low-humidity environment, the standby time, that is, the first predetermined time is set to be longer for all types of sheet than that in other environments (X<W, Z<Y), such that the projecting state of the clamp guides 14 is maintained for a possibly long time.

Such a standby time, that is, the first predetermined time can be calculated from the retracting speed and the retracting distance of the clamp guides 14 in use. In the case where Vc is the retracting speed of the clamp guides 14, and Lmax is the retracting distance when there are no stacked sheets Sa on the stacking trays 16, that is, when the clamp guides 14 project at the maximum, a time Tc required for the retract is given by:

$$Tc=L\max/Vc$$

Also, in the case where Ls is the distance from the sheet detection sensor 22 to the nipping portion of the conveyance rollers 12, Vs is the speed with which the conveyance rollers 12 convey the sheet, and Tw is the first predetermined time, a time Ts from when the clamp guides 14 start moving backward to when the sheet S comes off the nipping portion is expressed by:

$$Ts=Ls/Vs-Tw$$

Then, in order for the retract movement of the clamp guides 14 to be completed before the sheet S is away from the nipping portion, the following is necessary:

$Tc<Ts$, that is, $$L\max/Vc<Ls/Vs-Tw \qquad \text{Express 1}$$

In this respect, it is assumed that the speed Vs with which the conveyance rollers 12 convey the sheet varies depending on the use environments and/or the type of sheet. Considering such errors of the conveyance speed Vs, a Tw appropriate in accordance with each condition is determined in advance such that the expression 1 is satisfied under any condition.

For maintaining the projecting state during the conveyance of the sheet S as long as possible, an increase of the retracting speed of the clamp guides 14 is effective. Accordingly, the travel speed Vc of the clamp guides 14 will be adjusted to the extent that no problem arises on the endurance of the mechanism involved in the travel of the clamp guides 14, such as the clamp-guide motor 28, the torque limiters 27 and the like. Thus, for example, even if the friction is large to cause multi-feeding to occur easily, increasing the travel speed Vc of the clamp guides 14 makes it possible to maintain the projecting state for a longer time.

In another method, decreasing the conveyance speed of the sheet S is effective. The conveyance speed of the sheet S in the stacker 101 is required to be synchronized with the printer conveyance roller 3 until the sheet S during conveyance is cut by the cutter 8 of the printer 100, but after the cutting process, the stacker-specific conveyance control can be exercised. Accordingly, the conveyance speed Vs will be adjusted to the extent that no problem arises on the endurance of the mechanisms relating to the conveyance rollers 12, such as the conveyance motor 23, the torque limiter gear 31 and the like. By performing such control, for example, even in the case where the friction is large to cause multi-feeding to occur easily, decreasing the conveyance speed Vs of the sheet S makes it possible to set the first predetermined time Tw to an adequate large value. Further, when both the travel speed Vc of the clamp guides 14 and the conveyance speed Vs of the sheet S are adjusted, the first predetermined time Tw is able to be set to a larger value to further delay the time when the clamp guides 14 retract from the stacked sheets Sa. In this way, starting the backward movement of the clamp guides 14 at the time appropriate in accordance with the use environment of the stacker and the type of sheet enables the discharge and stacking of sheets to be stably executed under various conditions.

Figure 11:
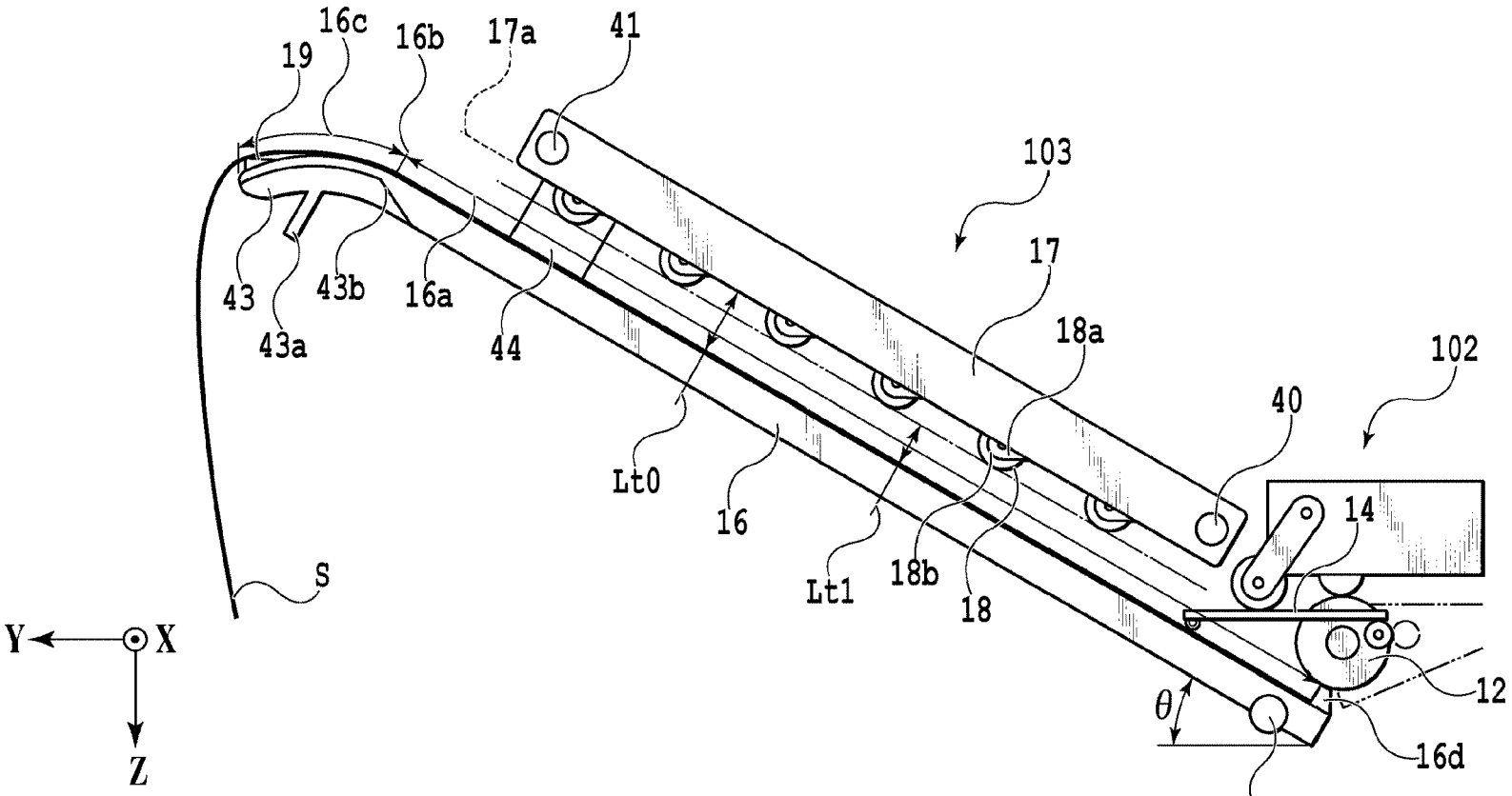
FIG. 11 is a sectional view illustrating a tray unit.

Next, the outline of the tray unit 103 will be described. FIG. 11 is a schematic sectional view illustrating the tray unit 103, which also shows a part of the conveyance unit 102 described above. As seen in FIG. 11, the stacking trays 16 are connected respectively to the clamp guides 14 in the conveyance direction, and further the upper guides 17 are placed opposite to the respective stacking trays 16 from above in the Z direction. Such a unitary unit made up of the clamp guide 14, the stacking tray 16 and the upper guide 17 has a width of about 25 mm in the X direction (direction perpendicular to the drawing).

Figure 12:
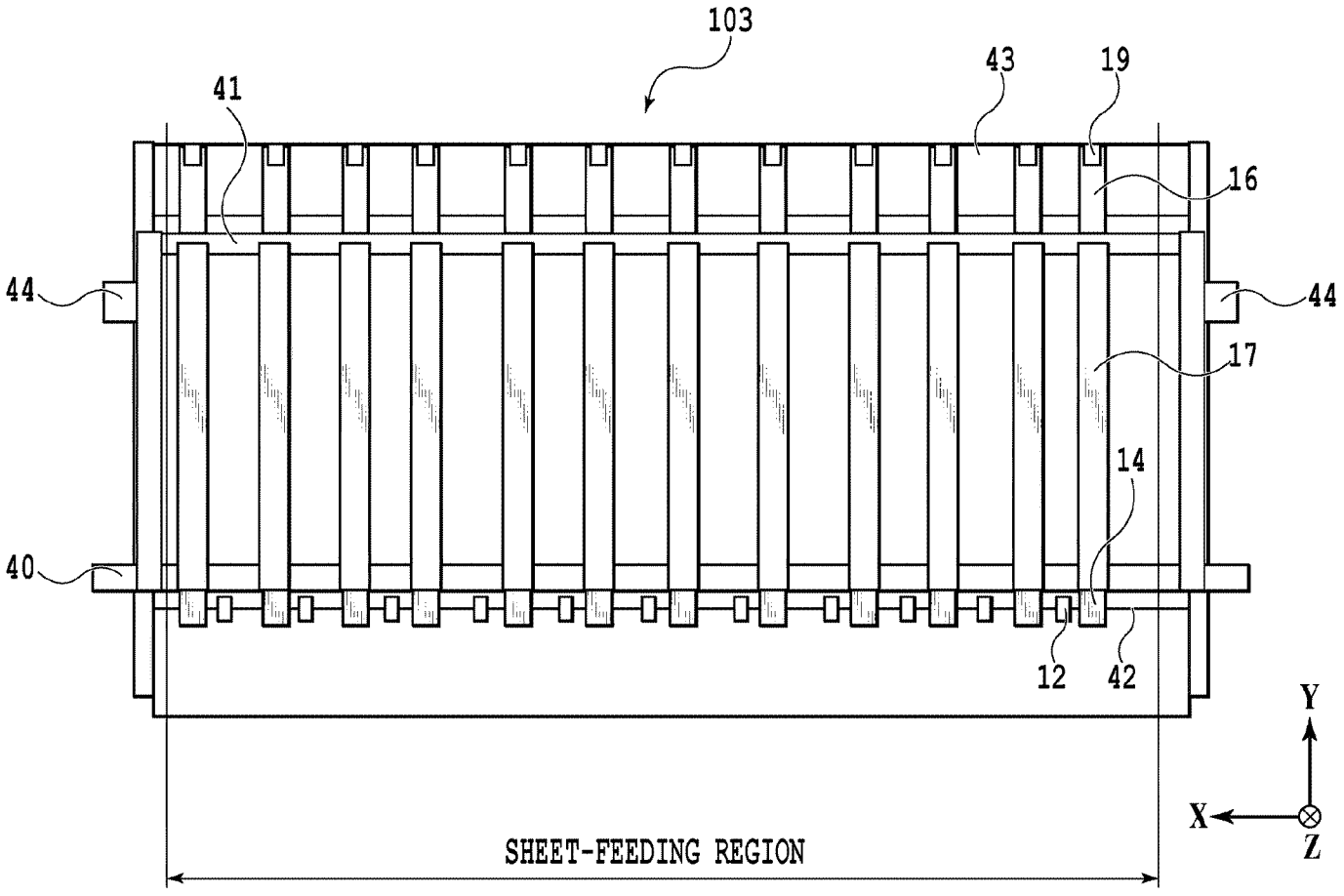
FIG. 12 is a top view illustrating the tray unit.

FIG. 12 is a top view illustrating the tray unit 103. A plurality of unitary units each of which is made up of the clamp guide 14, the stacking tray 16 and the upper guide 17 are arranged side by side in the X direction to form the tray unit 103 having a sheet-feeding region width corresponding to A0 size or larger. Such a ladder-shaped structure enables the provision of a tray unit at lower cost than an overall plate-shaped structure.

In addition, the tray unit 103 is designed such that, as long as the sheet S is of an A-series or B-series standard size, when one end of one side of the sheet S is aligned with a reference end in FIG. 12, the corresponding end of the other side of the sheet S is supported by any unitary unit. In other words, a plurality of the unitary units are positioned at intervals corresponding to widths of standard sizes in the X direction. Thus, the end of the sheet S located opposite to the reference end is prevented from hanging downward between a unitary unit and a unitary unit, promoting the stable conveyance.

A plurality of the stacking trays 16 are connected to each other on the upstream side in the conveyance direction by a rod-shaped tray upstream frame 42 extending in the X direction, and on the downstream side by a curved-surface shaped tray downstream frame 43 extending in the X and Y directions. On the other hand, a plurality of the upper guides 17 are connected to each other on the surrounding by an upper-guide frame 41, and on the upstream side in the conveyance direction by an upper-guide rotating shaft 40. Further, stoppers 44 are attached to both sides around the downstream end of the upper-guide frame 41 to abut on both sides of a set of the opposite stacking trays 16 to maintain a constant distance from the stacking trays 16. The user can use the stoppers 44 as handles to rotate a plurality of the upper guides 17 fixed to the upper-guide frame 41 about the upper-guide rotating shaft 40 for removal of the stacked sheets Sa stacked on the stacking tray 16.

Referring to FIG. 11 again, each of the stacking trays 16 has a linear or approximately linear inclined surface **16*a* having a predetermined angle θ with respect to the horizontal direction, and the curved surface 16*c* being contiguous with the inclined surface 16*a* and having a predetermined curvature. The discharged sheet S travels to move up the slope of the inclined surface 16***a* against gravity toward the curved surface 16*c* formed on the crest. Then, when the sheet S has an adequately large size, the sheet S is held as shown in FIG. 11 with the leading end extending beyond the curved surface 16*c* to hang downward and a halfway portion being supported by the curved surface 16. In this supported state, ink applied by the printing is dried. The friction member 19 is attached to the vicinity of the distal end of the curved surface 16*c* for preventing the sheet S from slipping off even if vibrations or the like occurs. A grip 43*a* is attached to the underside of the tray downstream frame 43 to be used for moving the stacker 101.

A plurality of the inclined surfaces 16*a* arranged in the X direction have the respective upstream ends connected to each other and supported by the tray upstream frame 42 described earlier. On the other hand, a plurality of the curved surfaces 16*c* are supported in their nearly entire regions by the tray downstream frame 43 having a curvature equal to that of the curved surfaces 16*c*. The extension of the tray downstream frame 43 in the X and Y directions bridges the gaps between the curved surfaces arranged in the X direction. Thereby, even when a sheet S of any size other than a standard size is delivered, the leading end of the sheet S is infallibly supported by the curved surface 16*c* or the tray downstream frame 43. In this manner, irrespective of the size of the discharged sheet S, an adequate reduction in the risk of giving rise to damage and/or buckling is made possible.

In the present embodiment, the conveyance distance of the combination of the inclined surface 16*a* and the curved surface 16*c* is about 620 mm, and the inclination θ of the inclined surface 16*a* is 30°. This enables stacking and holding of even sheets of a large size such as an A0 standard size (1189 mm long) on the tray unit 103 without slipping-off.

Each of the upper guides 17 is placed to face the corresponding inclined surface 16*a* of the stacking tray 16 with a predetermined interval between them, and a plurality of guide rollers 18 are placed at equal intervals in the extension direction of the upper guide 17. Each of the guide rollers 18 has a roller 18*b* which is a rolling element rotated with making direct contact with the sheet S and an arm 18*a* supporting the roller 18*b*. The arm 18*a* is rotatable with one end attached to the upper guide 17. The rotating center of the arm 18*a* is located upstream of the roller 18*b*. In this way, the upper guide 17 has a structure including a plurality of driven rolling elements that are retracted by rotation of the arms upon being pushed by the sheet and are arranged in the sheet-conveyance direction. Thus, even when the number of sheets stacked is increased to decrease the distance between the top sheet and the upper guide 17, the driven rolling elements are pushed by the incoming sheet to move away, so that a sheet jam is hardly caused, leading to smooth stacking of sheets.

The stoppers 44 maintain a constant sheet-feeding interval Lt0 between upper guide sheet-feeding surfaces 17*a* of the main bodies of the upper guides 17 and the inclined surfaces 16*a* of the stacking trays 16 facing the surfaces 17*a*. The upper guides 17 operate to promote the conveyance of the sheet S while reducing the curl to achieve the sheet stacking in a predetermined posture. To meet this need, the sheet-feeding interval Lt0 is desirably controlled to the extent that the leading end of the incoming sheet S does not curl between the stacking trays 16 and the upper guides 17, that is, to be a distance smaller than a minimum diameter which may be shown by a curled sheet S. In this respect, when the sheet S is held in a roll form as described in FIG. 1, a minimum radius of curvature which may be shown by a curled sheet can be assumed to be a radius of the roll core. Accordingly, the sheet-feeding interval Lt0 is preferably set to be equal to or less than the diameter of the roll core of the roll sheet 1. The present embodiment employs the roll sheet with the roll core being 58.8 mm in outer diameter, and the sheet-feeding interval Lt0 is set at 20 mm.

On the other hand, each of the guide rollers 18 attempts to rotate in a vertically downward direction (Z direction) because of the weight of the roller 18*b*, but an unillustrated stopper inhibits the guide roller 18 from rotating beyond a predetermined position. As a result, when conveyance is not performed, the guide roller 18 keeps the posture illustrated in FIG. 11, so that the gap distance LT1 (<Lt0) between the roller 18*b* and the inclined surface 16*a* is kept constant. Then, when the curved surface of the sheet S during conveyance comes into contact with the roller 18*b*, the guide roller 18 is designed to rotate vertically in a range above the position shown in FIG. 11 in accordance with the undulations of the sheet curved surface.

Preferably, the gap distance Lt1 is a height which keeps the roller 18 from making contact with the top sheet of the stacked sheets Sa even when the number of sheets stacked increases to the maximum. In the present embodiment, assuming that the thickness of the sheet S is 0.1 mm and the maximum value of the number of sheets is 100, the gap distance Lt1 is adjusted to be a value equal to or larger than 0.1×100=10 mm.

Figure 13:
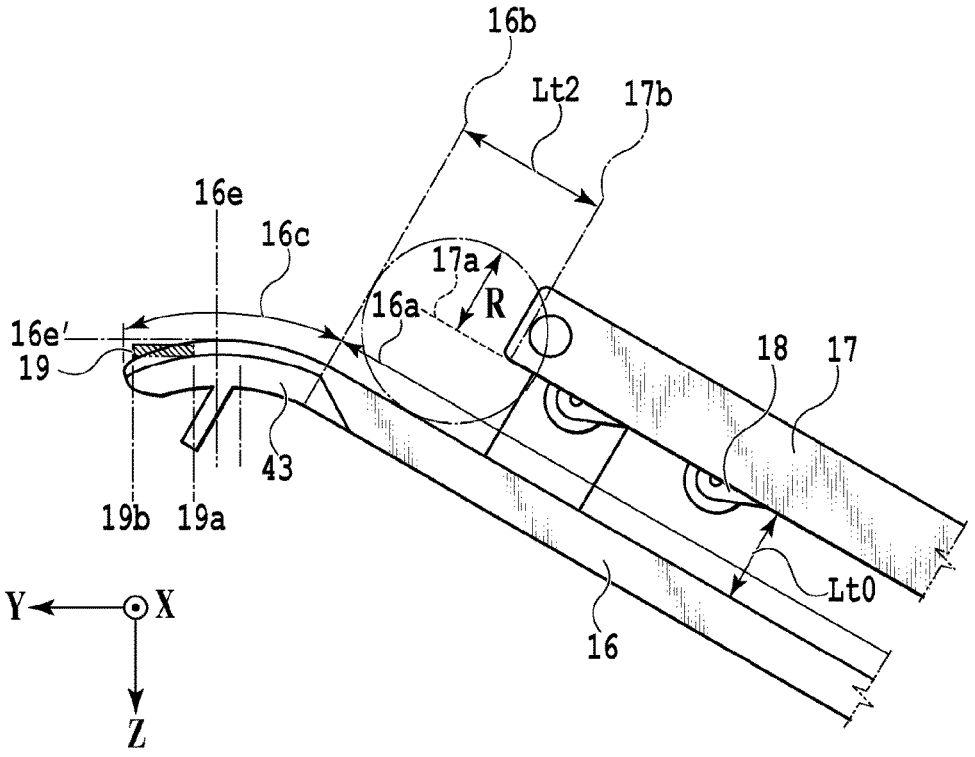
FIG. 13 is an enlarged sectional view illustrating the vicinity of the downstream end of the tray unit.

FIG. 13 is an enlarged sectional view illustrating the vicinity of the downstream end of the tray unit 103, in which the tray rotating devices 48 are removed for purposes of illustration. A downstream end of each upper guide 17 is located halfway through the inclined surface 16*a* of the stacking tray 16, that is, upstream in the conveyance direction from the boundary (an inflection point 16*b*) between the inclined surface 16*a* and the curved surface 16*c*. In this way, the sheet S is released from the control of the upper guides 17 in a place before the curved surfaces 16*c* with a curvature for supporting the sheet S.

Figure 14A:
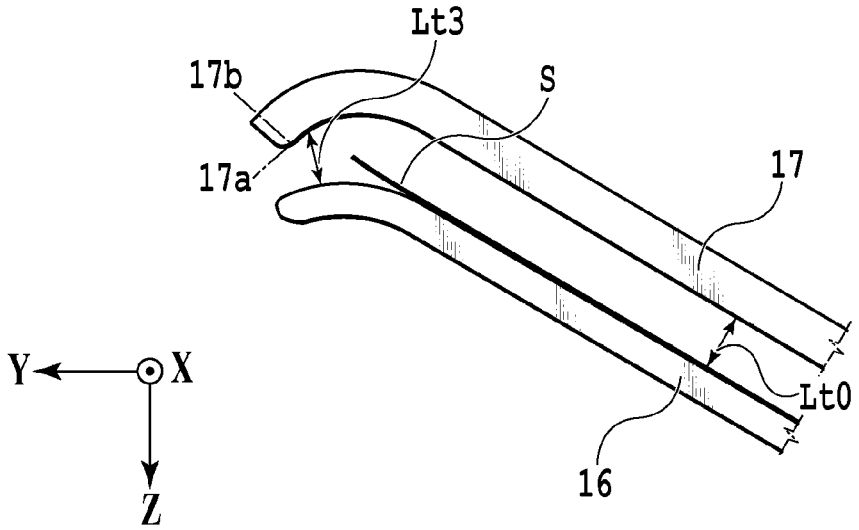
FIGS. 14A and 14B are diagrams illustrating a comparison example to an embodiment according to the present invention.
Figure 14B:
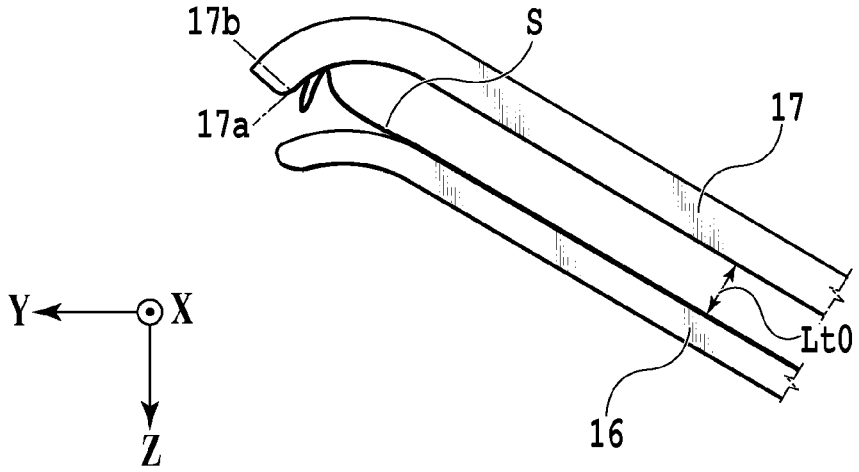

FIG. 14A and FIG. 14B are diagrams showing a comparison example in which an upper guide is placed approximately parallel to the curved surface 16*c* to extend to the extremity of the curved surface 16*c* without the adoption of the structure according to the present embodiment. This example shows a case of conveying a high-density print, such as a photograph or the like, as the sheet S. In the conveyance of the high-density print such as a photograph or the like, the sheet S moves straight forward without changing the conveyance direction even after passing through the inclined surface, as shown in FIG. 14A, while being wavy in a galvanized-corrugated-sheet form. Then, as illustrated in FIG. 14B, when the leading end of the sheet S collides with the sheet-feeding surface of the upper guides 17, the sheet may be damaged or a sheet jam may occur. Alternatively, when the sheet S collides with the guide roller 18 protruding from the upper guide 17, the sheet may possibly be damaged by contact with the guide roller 18. For this reason, the downstream ends 17*b* of the upper guides 17 are preferably placed upstream of the curved surfaces 16*c*.

Figure 15A:
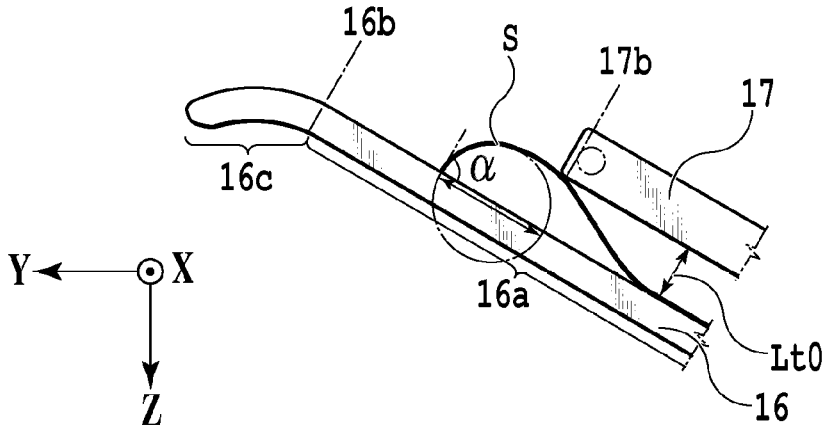
FIGS. 15A and 15B are diagrams illustrating the adverse effects on the conveyance when the downstream end of the upper guide is placed farther upstream than necessary.
Figure 15B:
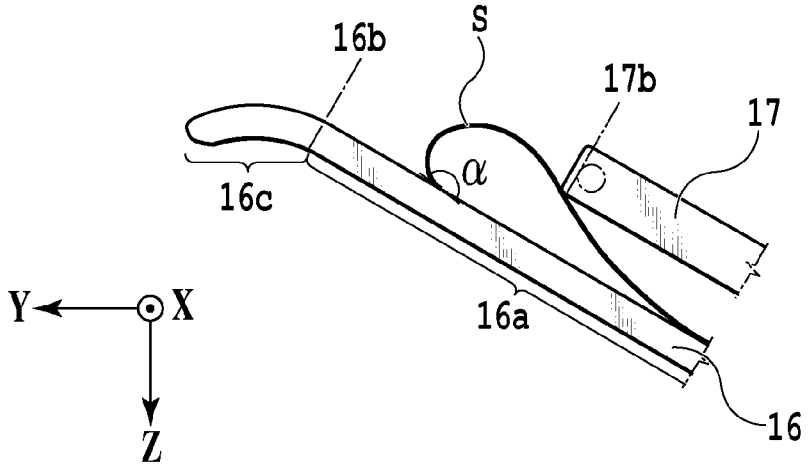

However, if the downstream end 17*b* of the upper guide 17 is located farther upstream than necessary, adverse effects may be produced on conveyance in an inoperative region of the function of the upper guide 17. FIGS. 15A and 15B are diagrams illustrating an adverse effect on conveyance when the downstream end 17*b* of the upper guide 17 is located farther upstream than necessary. Upon the release of the curled sheet S from the pressure of the upper guide 17 on the inclined surface 16*a* for straight-forward conveyance, the leading end of the sheet S begins to curl (FIG. 15A). Then, when the contact angle α of the leading end of the sheet S with respect to the inclined surface 16*a* exceeds 90°, the sheet S becomes rounded as shown in FIG. 15B to cause the leading end to move in the direction opposite to the conveyance direction.

To avoid this, in the present embodiment, the location of the downstream end 17*b* of the upper guide 17, that is, the length of the upper guide 17 is adjusted to the extent that neither of a collision of the leading end of the sheet S shown in FIGS. 14A and 14B and sheet rounding shown in FIGS. 15A and 15B occurs. The conditions for the purpose are described below.

Figure 16A:
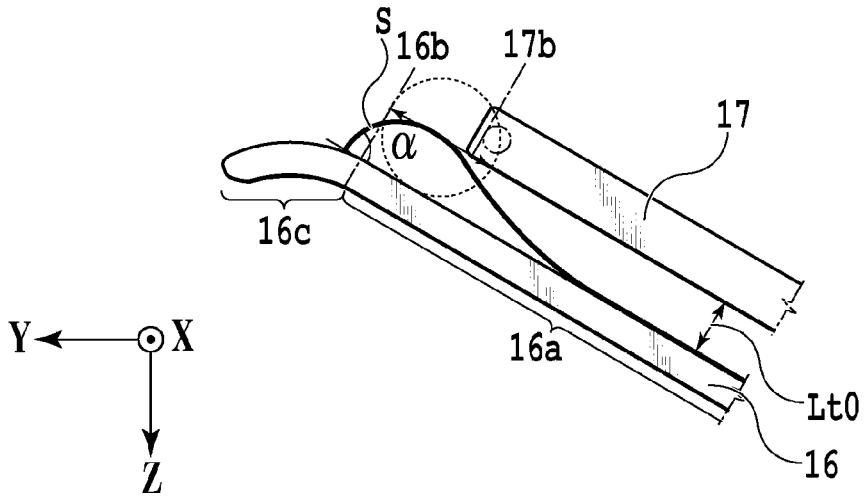
FIGS. 16A and 16B are diagrams illustrating a contact angle of the leading end of the sheet with the upper guide.
Figure 16B:
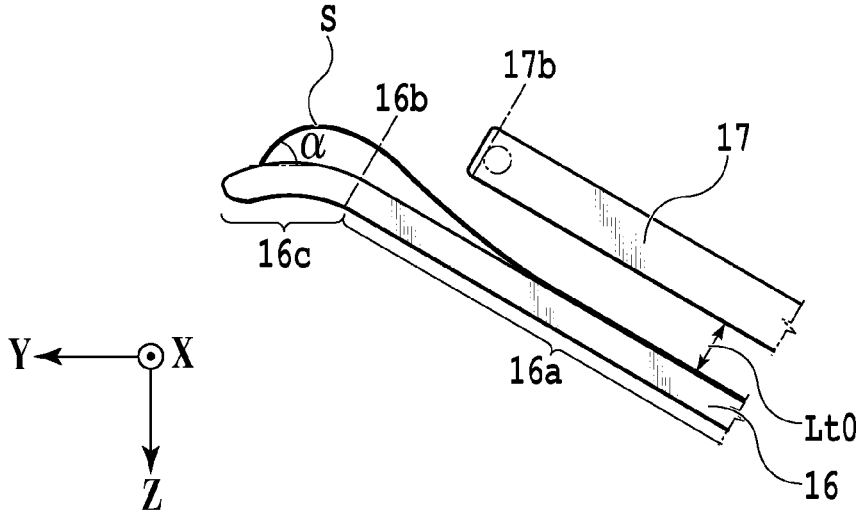

Referring to FIG. 13 again, in order to prevent the leading end of the sheet released from the upper guides 17 from forming a contact angle of 90° or larger with the inclined surfaces 16*a*, the leading end of the sheet S needs to pass through the inflection point 16*b* as shown in FIG. 16A before the contact angle α increasing with the travel of the sheet reaches 90°. Thus, with the above configuration, even if the conveyance progresses as it is, the sheet S is able to continue to travel in an appropriate direction while being guided by the curved surface 16*c* as shown in FIG. 16B without curling at the end of the sheet as shown in FIG. 15B. For the satisfaction of such conditions, in a case where R is the minimum radius of curvature which may be shown by the sheet S, the distance Lt2 between the downstream end 17*b* of the upper guide 17 and the inflection point 16*b* is required to be less than 2R (Lt2<2R) in the travel direction of the sheet.

FIG. 17 is a table showing the minimum curl diameter (2R) for each type of sheet. Although there are variations from type to type, it has been investigated that the average was 1.2 times the outer diameter of the roll core of the roll sheet 1 held by the printer 100. In the present embodiment, assuming that the roll core of the roll sheet 1 used has an outer diameter of 58.8 mm and a conceivable minimum curl diameter 2R is 70.6 mm corresponding to 1.2 times the outer diameter of the roll core, the position of the downstream end 17*b* of the upper guide 17 is determined. Specifically, the distance Lt2 between the inflection point 16*b* and the end 17*b* of the upper guide 17 is set to be 58 mm (<70.6 mm) in the travel direction of the sheet. As a result, even in a case where a sheet with curl is conveyed, the sheet can hang downward from the curved surfaces 16*c* without curling at the sheet leading end, making it possible to normally carry out the sheet conveyance and the sheet stacking.

Referring back to FIG. 13, the friction member 19 for preventing the sheet S from slipping off even in occurrence of disturbance such as vibrations is placed in the vicinity of the end of the curved surface 16*c*. The friction member 19 is made of material, such as artificial leather being more flexible and having a higher coefficient of friction than the stacking tray 16. The friction member 19 is attached such that the surface is maintained to be nearly horizontal in a position lower in the Z direction than a tangential line 16*e*' in the top point 16*e* of the curved surface 16*c*. An upstream end 19*a* of the friction member 19 in the Y direction is located in a position lower in the Z direction than the curved surface 16*c*, but a downstream end 19*b* thereof in the Y direction is located in a position higher in the Z direction than the curved surface 16*c*. Therefore the incoming sheet S can be conveyed with the leading end of the sheet S not catching on the upstream end 19*a* of the friction member 19 while generating an appropriate amount of friction forces between the underside of the sheet S and the friction member 19. As the sheet number of the stacking sheets Sa increases, the friction force between the sheet S in the lowermost position and the friction member 19 increases the further due to their own weight, making it possible to prevent the stacking sheets Sa from slipping off the stacking trays 16.

Figure 18:
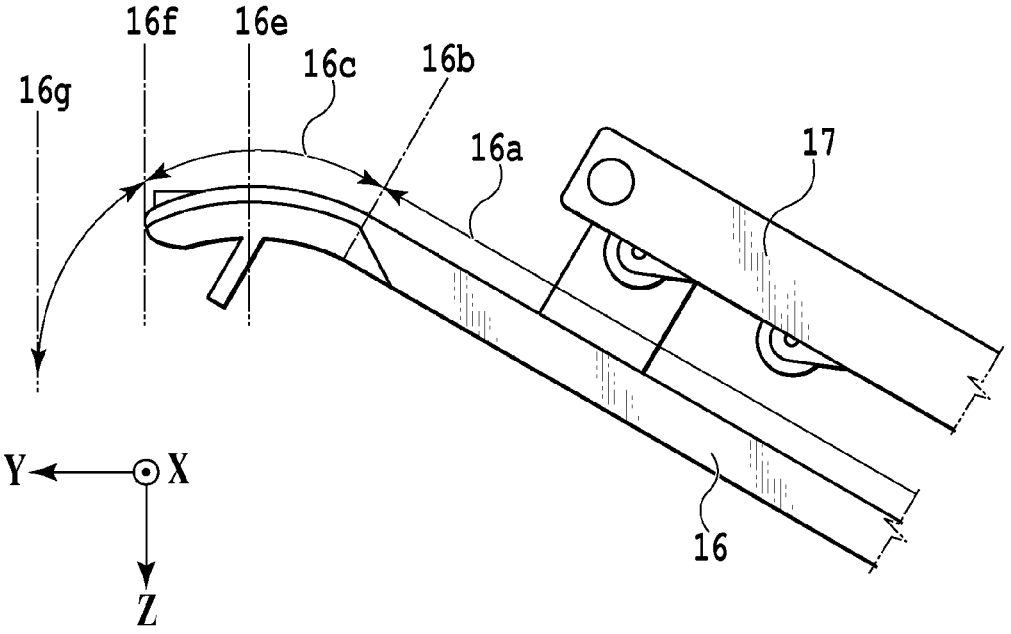
FIG. 18 is an enlarged view illustrating the shape of the curved surface in detail.

FIG. 18 is an enlarged view illustrating the shape of the curved surface 16*c* in detail. The hanging sheet S is supported on the curved surface 16*c*, a force is not applied in a localized manner to the underside of the sheet S, so that buckling damage and the like hardly occur. However, when the curvature of the curved surface 16*c* is increased to the extent that the curved surface 16*c* itself is involved in curl of the leading end of the sheet, such an effect is less exerted. For this reason, the curvature radius of the curved surface is desirably set to be larger than the conceivable minimum radius R of curvature. The curved surface 16*c* in the present embodiment is formed such that the radius of curvature is 30 mm (60 mm in diameter).

On each curved surface 16*c* extending at a predetermined curvature from the inflection point 16*b* to the distal end 16*f*, the distal end 16*f* preferably extends beyond a top point 16*e* in the Z direction of the curvature surface 16*c*. This is because, if the distal end 16*f* is located closer to the inflection point 16*b* rather than the top point 16*e*, a force is locally applied to the underside of the hanging sheet S at the position of the distal end 16*f*, increasing the risk of leaving a bend. On the other hand, the range of the curved surface 16*c* with a curvature being able to suitably support the hanging sheet S on its surface is up to a position 16*g* at which a tangential line of the curved surface 16*c* becomes vertical. Even if the curved surface 16*c* extends beyond this position, the curved surface 16*c* is incapable of supporting the sheet hanging downward in the vertical direction. That is, it is sufficient that the distal end 16*f* of the curved surface 16*c* extends to the position 16*g* at the maximum. In the present embodiment, the inclined surface 16*a* is described as a flat surface without a curvature, but it can be designed as a curved surface with a less steep curvature than the curved surface 16*c*.

As explained above, in the stacker 101 a plurality of the clamp guides 14 are arranged in the width direction of the sheet S to be capable of moving forward and backward in such a manner as to block the level difference gap H to the stacking trays 16. The amount of travel is controlled for each of the clamp guides 14 such that the extent of travel of the clamp guide 14 differs depending upon the stacking amount of the sheets already stacked on the stacking trays 16. As a result, the level difference gap H to the stacking tray 16 or the stacked sheet Sa can be blocked in any position of the width direction regardless of sizes of the already stacked sheets to prevent the leading end of the incoming sheet S newly conveyed from entering into the level difference gap H.

In addition, the stacker 101 places the stacking tray 16 formed of the inclined surface 16*a* for carrying in and conveying the sheet S and the curved surface 16*c* having a larger curvature than that of the inclined surface 16*a* for receiving the sheet S from the inclined surface 16*a* and conveying it. The upper guide 17 is placed in a predetermined position to face only the inclined surface 16*a* for reducing the curl of the sheet S conveyed on the stacking tray 16. As a result, it is possible to provide the stacker that can smoothly discharge, and orderly stack and hold a plurality of the sheets S while reducing the curl of the sheets S during the conveyance.

(Modifications)

Figure 19:
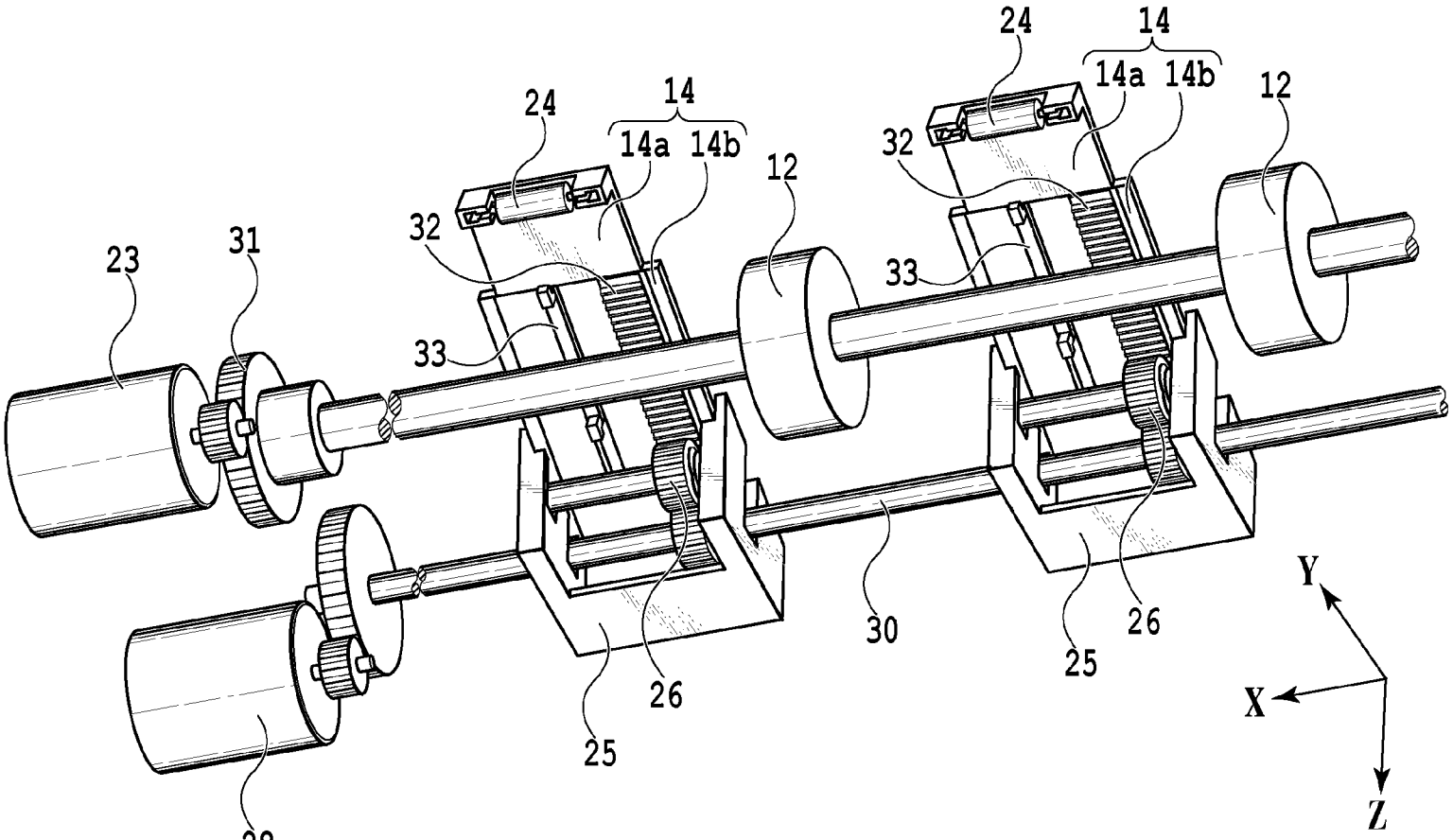
FIG. 19 is a perspective view illustrating the drive structure in a modification of clamp guides.

Hereinafter, some of modifications will be explained. FIG. 19 is a perspective view illustrating the drive structure in a modification of clamp guides 14. Spring members are used in place of the torque limiters 27 in the precedent embodiment to limit the travel of the clamp guides 14. The clamp guide 14 is formed of a guide plate 14*a* that tends to relatively easily warp in response to external pressure, and a guide case 14*b* that holds the guide plate 14*a* to be capable of being taken in and out in the Y direction. A spring 33 (spring member) is attached on the guide case 14*b* to urge the guide plate 14*a* in a direction of projecting from the guide case 14*b*.

The clamp guides 14 respectively are held by holders 25, and a plurality of the holders 25 are connected through the common clamp-guide shaft 30 to the clamp-guide motor 28. The gears 26 rotate in a forward or backward direction by a drive of the clamp-guide motor 28 to move the guide cases 14*b* forward or backward in the Y direction through the guide rails 32 meshing with the gears 26.

The guide case 14*b* moves in the Y direction by a distance in accordance with a drive amount of the clamp-guide motor. However, when the roller 24 attached on the leading end of the guide plate 14*a* collides with the stacked sheets S or the stacking tray 16, the guide plate 14*a* compresses the spring 33 according to the received reaction and attempts to return back into the guide case 14*b*. As a result, as similar to the precedent embodiment, in a plurality of the clamp guides 14 arranged in the X direction, the extent of the travel differs in accordance with the thickness of the stacked sheets in each position.

Figure 20:
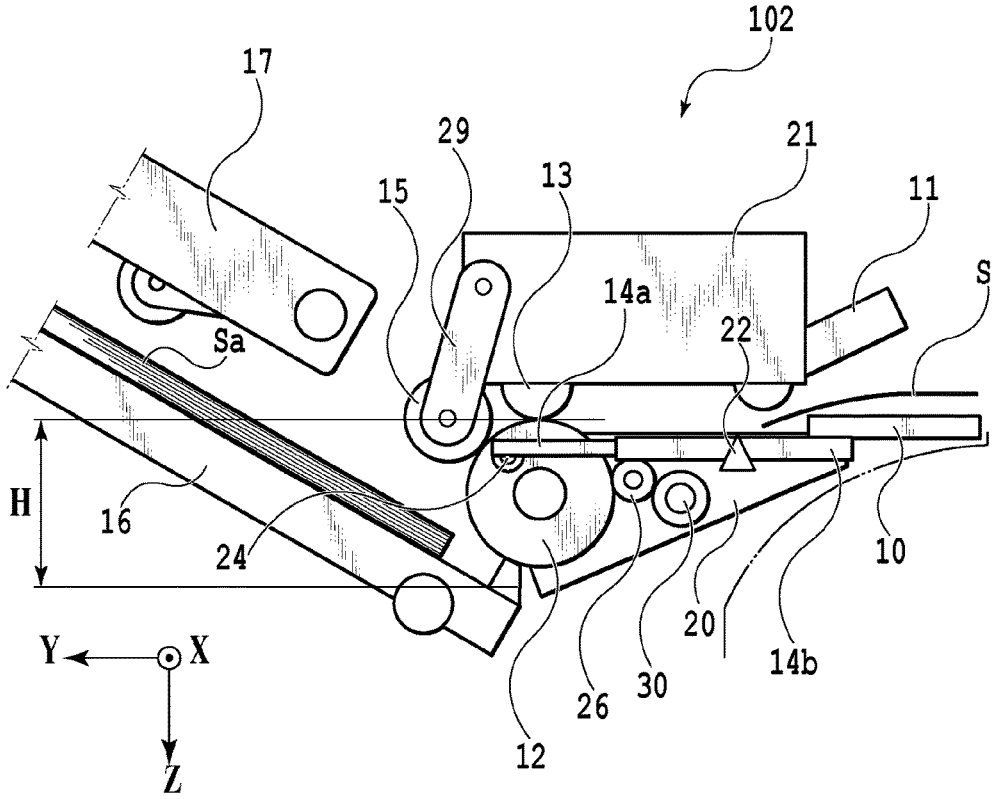
FIG. 20 is a diagram illustrating the retract state of the clamp guide.

FIG. 20 illustrates the retract state where the clamp guide 14 is retracting. In the retract state, the guide plate 14*a* projects from the guide case 14*b* since the guide plate 14*a* is not subjected to forces other than the spring 33. However, since the guide case 14*b* sufficiently retracts in the negative Y direction, both the guide plate 14*a* and the guide case 14*b* are in a state of being accommodated in the conveyance lower guide 20. In this state, the roller 24 located in the leading end of the guide plate 14*a* is in a position of being accommodated within an outer diameter of the conveyance roller 12. Therefore the discharge roller 15 is located in a position of coming in contact with the conveyance roller 12 due to the own weight. The level difference gap H between the stacking trays 16 and the nipping portion between the pinch roller 13 and the conveyance roller 12 is exposed. As similar to the precedent embodiment, at the time when the leading end of the sheet S newly discharged does not still reach the sheet detection sensor 22, such a retract state is maintained. In addition, at the time when the rear end of the sheet S newly discharged leaves the nipping portion between the pinch rollers 13 and the conveyance rollers 12, this retract state is designed to be realized. When the retract state is realized at the time when the rear end of the sheet S leaves the nipping portion, the rear end of the sheet S can drop in the level difference gap H to be aligned with the rear ends of the stacked sheets Sa already located on the stacking trays 16.

Figure 21:
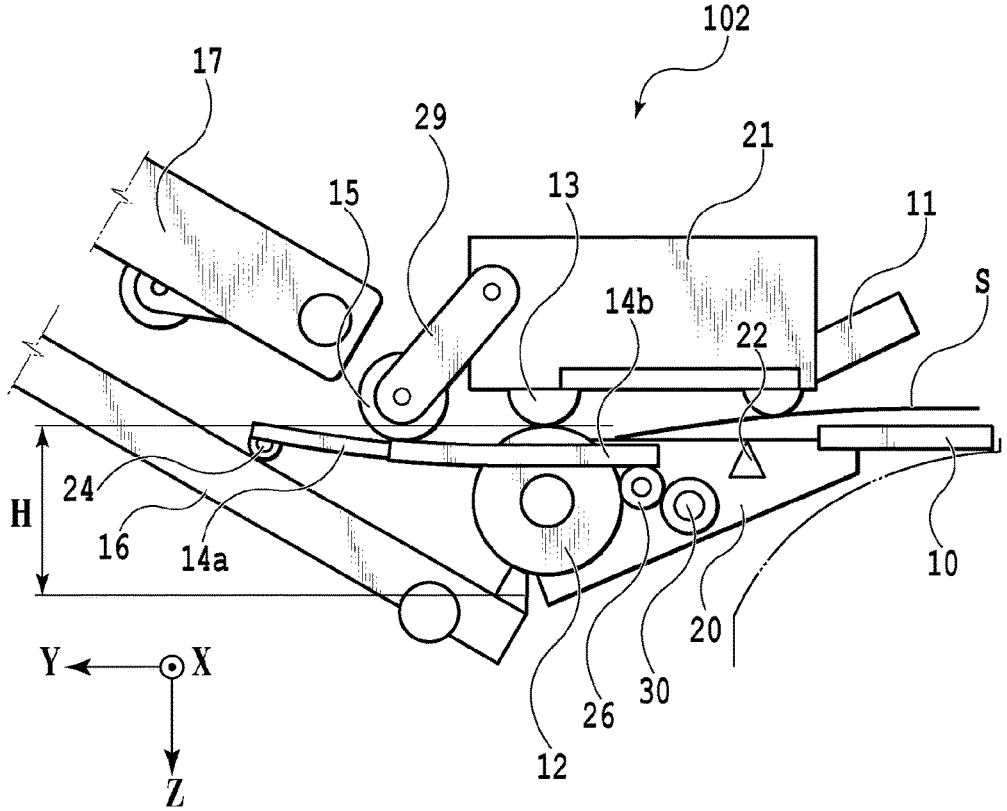
FIG. 21 is a diagram illustrating the projecting state of the clamp guide.

FIG. 21 illustrates the projecting state of the clamp guide 14. Here, there is illustrated a state where the stacked sheets Sa do not exist on the stacking tray 16 and the roller 24 abuts directly on the stacking tray 16. In the projecting state, the guide case 14*b* moves forward by a determined distance in the positive Y direction, but the guide plate 14*a* is pushed back into the guide case 14*b* in accordance with the reaction that the roller 24 has received from the stacking tray 16. As a result, the level difference gap H from the nipping portion between the pinch roller 13 and the conveyance roller 12 to the stacking trays 16 is blocked by the clamp guides 14, so that the sheet jam is not caused by the entering of the leading end of the sheet S released from the discharge roller 15 into the level difference gap H.

Figure 22:
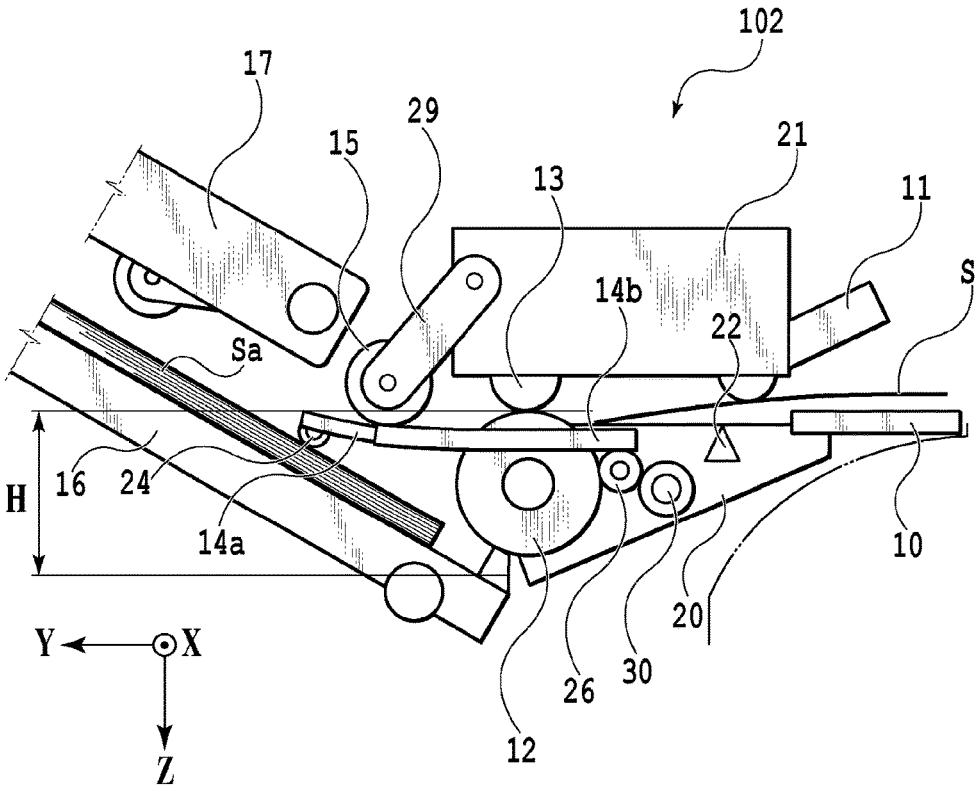
FIG. 22 is a diagram illustrating the projecting state of the clamp guide.

FIG. 22 illustrates the projecting state when the stacked sheets Sa exist on the stacking trays 16. As similar to FIG. 21, the guide plate 14*a* is pushed back into the guide case 14*b* in accordance with the reaction that the roller 24 has received from the stacking tray 16, but is further pushed back by the amount of the thickness of the stacked sheets Sa than in FIG. 21. In this state also, the level difference gap H from the nipping portion between the pinch rollers 13 and the conveyance rollers 12 to an upper surface of the stacked sheets Sa is appropriately blocked by the clamp guide 14, so that the leading end of the sheet S released from the discharge roller 15 does not enter into the level difference gap H. From a point where the leading end of the sheet S newly discharged has reached the sheet detection sensor 22 to a point where a little while elapses after the rear end of the sheet S has reached the sheet detection sensor 22, the projecting state as illustrated in FIG. 21 or FIG. 22 is maintained.

In this way, in the present modification also, the level difference gap to the stacking tray 16 or the stacked sheets Sa can be appropriately blocked in any position of the width direction (X direction) regardless of a size and amount of the already stacked sheets. As a result, the leading end of the incoming sheet S newly conveyed does not enter into the level difference gap, thus making it possible to realize the conveyance without a hitch.

Figure 23A:
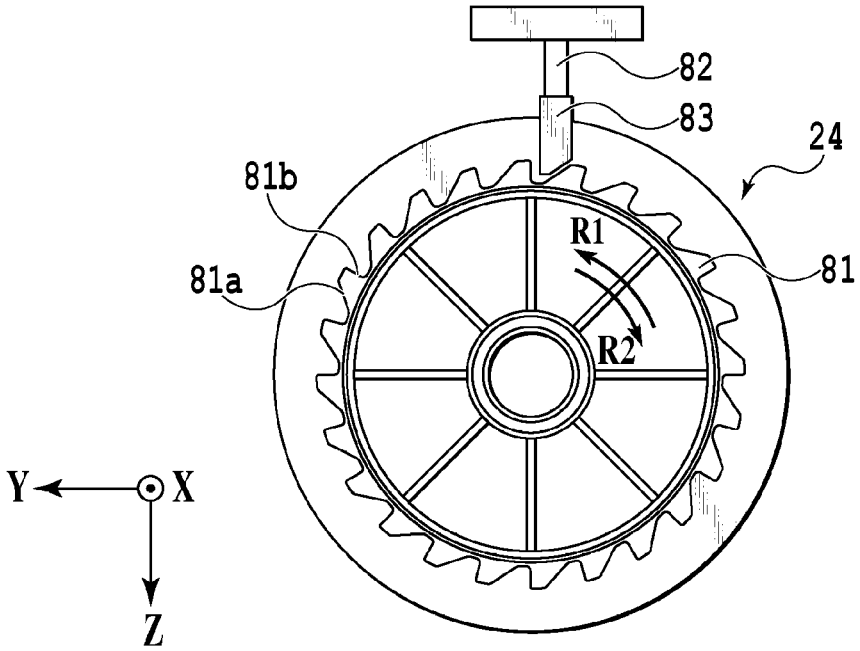
FIGS. 23A and 23B are enlarged side views illustrating a modification of a roller.
Figure 23B:
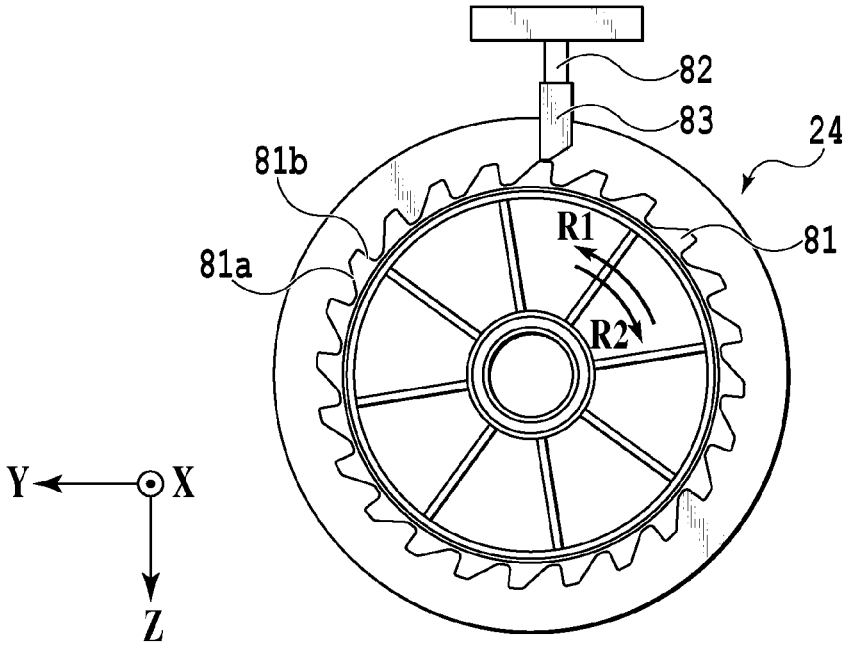

FIGS. 23A and 23B are enlarged side views illustrating a modification of a rolling element of a clamp guide. A tooth face 81 having inclined portions 81*a* and wall portions 81*b* alternately arranged is fixed on the roller 24 to rotate coaxially and integrally with the roller 24. A rotation restricting member 83 capable of meshing with the shape of the tooth face 81 is placed upward in the Z direction to the tooth face 81, and the rotation restricting member 83 is urged in the positive Z direction by a rotation restricting spring 82.

When the roller 24 is rotated in the R1 direction in this structure, the rotation restricting member 83 is pushed up along the inclined portion 81*a* of the tooth face 81 and goes down along the wall portion 81*b* in a repetition manner. That is, while the state in FIG. 23A and the state of FIG. 23B are repeated, the roller 24 can continue to rotate in the R1 direction. On the other hand, when the roller 24 is caused to be rotated in the R2 direction, once the state in FIG. 23A occurs, the rotation restricting member 83 blocks the wall portion 81*b* of the tooth face 81 from rotating in the R2 direction. That is, the roller 24 cannot rotate in the R2 direction. In this manner, the roller 24 is the rolling element that can rotate in the R1 direction but cannot rotate in the R2 direction, that is, can be driven to be rotated only in one direction.

Hereinafter, there will be explained an operational effect when the roller 24 is attached to the leading end of the clamp guide 14 for use. When the roller 24 abuts on the stacking tray 16 or the stacked sheets Sa, that is, when the roller 24 transitions from the retract state to the projecting state, the roller 24 abuts thereon while moving forward in the Y direction. Therefore a force of causing the clamp roller 24 to rotate in the R1 direction acts on the clamp roller 24. The roller 24 can rotate only in the R1 direction. Accordingly as similar to the precedent embodiment, it is possible to reduce the curl while restricting the stacked sheets Sa from being misaligned in the Y direction without damaging the stacked sheets Sa.

On the other hand, in a state where the roller 24 is restraining the stacked sheets Sa, when the new sheet S is conveyed on the stacked sheets Sa, the stacked sheets Sa attempt to move forward in the Y direction with the friction force generated therebetween. At this time, a force of causing the clamp roller 24 to rotate in the R2 direction acts on the clamp roller 24. However, the roller 24 does not rotate in the R2 direction. Therefore it is possible to restrict the stacked sheets Sa from being misaligned in the Y direction to maintain the stacking position of the stacked sheets.

Figure 24A:
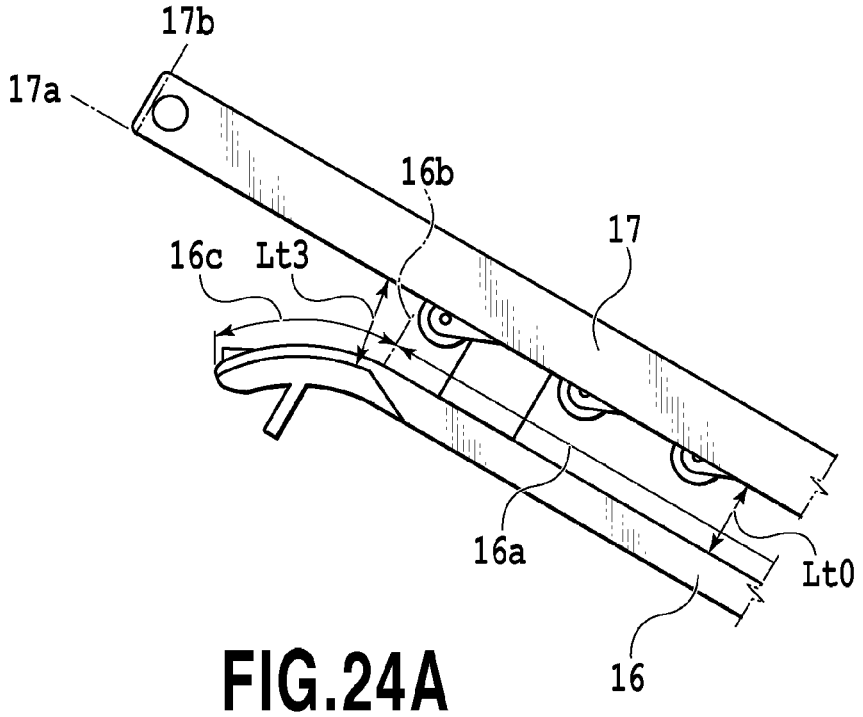
FIGS. 24A and 24B are sectional views illustrating a modification of an upper guide.
Figure 24B:
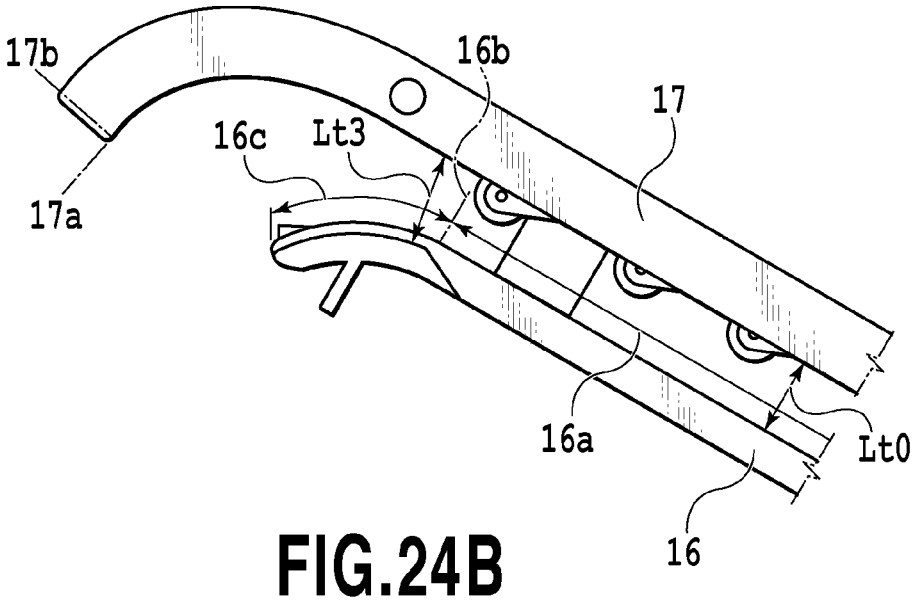

Next, FIGS. 24A and 24B are used to illustrate a modification of an upper guide. In the precedent embodiment, the upper guide 17 is placed only in a position facing the inclined surface 16*a*, and is not placed in a position facing the curved surface 16*c*. This is because by releasing the sheet S from the upper guide 17 before the curved surface, the collision of the sheet S as illustrated in FIGS. 14A and 14B is avoided. However, when the interval of each other is sufficiently secured, it is possible to place the upper guide 17 also in the position facing the curved surface 16*c*.

FIGS. 24A and 24B illustrate an example in which the distance Lt3 between the upper sheet-feeding surface 17*a* and the curved surface 16*c* is held to be large to the extent that the collision of the leading end of the sheet S is not concerned, and the upper guide 17 is placed to a position facing the curved surface 16*c*. FIG. 24A illustrates the structure in which the flat upper guide sheet-feeding surface 17*a* explained in the precedent embodiment extends beyond the curved surface 16*c* as it is. In this case, the distance between the inclined surface 16*a* and the upper guide sheet-feeding surface 17*a* is Lt0, but the distance Lt3 between the curved surface 16*c* and the upper guide sheet-feeding surface 17*a* becomes gradually larger than Lt0 since the curved surface 16*c* goes down with a curvature.

On the other hand, FIG. 24B illustrates the structure in which the upper guide sheet-feeding surface 17*a* extends above the curved surface 16*c*, while having a curvature in a state of being sufficiently spaced from the curved surface 16*c*. Even in this structure, the distance Lt3 between the upper sheet-feeding surface 17*a* and the curved surface 16*c* can be made larger than the distance Lt0 between the inclined surface 16*a* and the upper guide sheet-feeding surface 17*a*. As a result, the leading end of the sheet S is conveyed without collision of the leading end of the sheet S with the upper guide sheet-feeding surface 17*a* and without a hitch, and can be held in a state of hanging downward from the curved surface 16*c*. When the upper guide as illustrated in FIGS. 24A and 24B is adopted, costs relating to the upper guide increase, but it is possible to protect the surface of the sheet S discharged and hanging downward from the curved surface 16*c* by the upper guide.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a Divisional of U.S. patent application Ser. No. 14/859,557, filed on Sep. 21, 2015, which claims the benefit of Japanese Patent Application No. 2014-199753 filed Sep. 30, 2014, which are hereby incorporated by reference herein in their entireties.

What is claimed is:

1. A sheet stacking apparatus on which a sheet printed by a printing unit is stacked, comprising:

a stacking tray on which the sheet is stacked;

a movable guide configured to guide the sheet to the stacking tray, the movable guide being movable between a retracted state and a projecting state, the movable guide when in the projecting state being positioned further downstream in a conveying direction of the sheet than when in the retracted state;

a discharge roller configured to convey the sheet while nipping the sheet with the movable guide when the movable guide moves to the projecting state; and a torque limiter configured to act on the movable guide to stop movement of the movable guide.

2. The sheet stacking apparatus according to claim 1, wherein the movable guide moves from the retracted state to the projecting state when the leading end of the sheet moves on the upper surface of the movable guide, the movable guide moves from the projecting state to the retracted state when the trailing end of the sheet moves on the upper surface of the movable guide, and the trailing end of the sheet is discharged on the stacking tray by the discharge roller.

3. The sheet stacking apparatus according to claim 1, wherein the movable guide includes a plurality of clamp guides arranged in a width direction of the sheet, and the clamp guides move from the projecting state to the retracted state by a common driving unit such that a leading end of each of the clamp guides abuts on the sheet placed on the stacking tray or on the stacking tray.

4. The sheet stacking apparatus according to claim 3, wherein each of the clamp guides has a roller that abuts the sheet or the stacking tray when the movable guide takes the projecting state.

5. The sheet stacking apparatus according to claim 1, further comprising an upper guide facing the stacking tray to form a space between the upper guide and the stacking tray, wherein a plurality of driven rolling elements are arranged on the upper guide along a direction in which the sheet moves up in the space.

6. The sheet stacking apparatus according to claim 1, wherein the stacking tray comprises a plurality of surfaces which are divided in a width direction of the sheet.

7. The sheet stacking apparatus according to claim 1, wherein the sheet stacked on the stacking tray is clamped at a sheet surface in a vicinity of the trailing end of the sheet by the movable guide that takes the projection state.

8. The sheet stacking apparatus according to claim 1, wherein the printing unit is an inkjet printer, and a plurality of sheets printed by the printing unit are discharged one by one and stacked on the stacking tray.

* * * * *